US008081764B2

(12) United States Patent
Takagi et al.

(10) Patent No.: US 8,081,764 B2
(45) Date of Patent: Dec. 20, 2011

(54) AUDIO DECODER

(75) Inventors: Yosiaki Takagi, Kanagawa (JP); Kok seng Chong, Singapore (SG); Takeshi Norimatsu, Hyogo (JP); Shuji Miyasaka, Osaka (JP); Akihisa Kawamura, Osaka (JP); Kojiro Ono, Osaka (JP)

(73) Assignee: Panasonic Corporation, Osaka (JP)

( * ) Notice: Subject to any disclaimer, the term of this patent is extended or adjusted under 35 U.S.C. 154(b) by 1034 days.

(21) Appl. No.: 11/993,066

(22) PCT Filed: Jul. 11, 2006

(86) PCT No.: PCT/JP2006/313783

§ 371 (c)(1),
(2), (4) Date: Dec. 19, 2007

(87) PCT Pub. No.: WO2007/010785

PCT Pub. Date: Jan. 25, 2007

(65) Prior Publication Data

US 2010/0235171 A1 Sep. 16, 2010

(30) Foreign Application Priority Data

Jul. 15, 2005 (JP) ..... 2005-207693
Jul. 15, 2005 (JP) ..... 2005-207754

(51) Int. Cl.
*H04R 5/00* (2006.01)

(52) U.S. Cl. ..... 381/23; 381/20; 381/1

(58) Field of Classification Search ..... 381/93, 381/94.1–94.9, 71.1, 71.2, 71.7–71.14, 19–23; 327/551, 552
See application file for complete search history.

(56) References Cited

U.S. PATENT DOCUMENTS 7,289,626 B2 * 10/2007 Carter et al. ..... 379/387.02
(Continued)

FOREIGN PATENT DOCUMENTS

CN 1264533 8/2000
(Continued)

OTHER PUBLICATIONS

Shida et al., "Variable Equalizer with Differential Amplifiers" IEEE, Transactions on Circuits and Systems, vol. CAS-24, No. 6, Jun. 1977, pp. 318-320.*

(Continued)

*Primary Examiner* — Alexander Ghyka
*Assistant Examiner* — Leonard Chang
(74) *Attorney, Agent, or Firm* — Wenderoth, Lind & Ponack, L.L.P.

(57) ABSTRACT

Provided is an audio decoder which can reduce an amount of arithmetic operations while suppressing occurrence of aliasing noise. The audio decoder includes: a decoder (102) and an analysis filter bank (110) which generate, from a coded down-mixed signal, the first frequency band signal (x) corresponding to a down-mixed signal (M); a channel expansion unit (130) which converts the first frequency band signal (x) generated by the analysis filter bank (110) into output signals (y) corresponding to respective audio signals of N channels, using BC information; an synthesis filter bank (140) which performs band synthesis for the output signals (y) generate by the channel expansion unit (130) and thereby converts the output signals (y) into the respective audio signals of the N channels on a time axis; and an aliasing noise detection unit (120) which detects occurrence of aliasing noise in the first frequency band signal (x). The channel expansion unit (130) further prevents the aliasing noise from being included in the output signals (y), based on information detected by the aliasing noise detection unit (120).

8 Claims, 14 Drawing Sheets

U.S. PATENT DOCUMENTS

| | | | |
|---|---|---|---|
| 2005/0149339 | A1 | 7/2005 | Tanaka et al. |
| 2007/0255572 | A1 | 11/2007 | Miyasaka et al. |

FOREIGN PATENT DOCUMENTS

| | | |
|---|---|---|
| JP | 2004-248989 | 9/2004 |
| WO | 99/04498 | 1/1999 |
| WO | 2006/022124 | 3/2006 |

OTHER PUBLICATIONS

International Search Report issued Oct. 17, 2006 in the International (PCT) Application of which the present application is the U.S. National Stage.

Frank Baumgarte et al., "*Binaural Cue Coding—Part I: Psychoacoustic Fundamentals and Design Principles*", IEEE Trans. on Speech and Audio Processing, 2003, vol. 11, No. 6, pp. 509-519.

J. Herre et al., "*The Reference Model Architecture for MPEG Spatial Audio Coding*", 118th AES Convention, Barcelona, Spain, presented May 28-31, 2005, Convention Paper 6447.

Osamu Shimada et al., "*A Low Power SBR Algorithm for the MPEG-4 Audio Standard and its DSP Implementation*", 116th AES Convention, Berlin Germany, presented May 8-11, 2004, Convention Paper.

Supplementary European Search Report (in English language) issued in European patent application No. 06768096.7 on Oct. 6, 2008.

* cited by examiner

AUDIO DECODER

TECHNICAL FIELD

The present invention relates to audio decoders which decode coded data generated from down-mixed signals of a plurality of channels, into signals of the original number of channels, by using coded information for dividing the coded data into the signals of the original number of channels, and more particularly to decoding processing performed by a Special Audio Codec according to Moving Picture Expert Group (MPEG) audio standards.

BACKGROUND ART

In recent years, in the MPEG audio standards, a technology called Spatial Audio Codec has been standardized. This technology aims for compression coding of multiple-channel signals for providing realistic sounding, with quite a small data amount. For example, while an Advanced Audio Coding (AAC) method, which is a multiple-channel codec widely used as an audio method for digital televisions, requires a bit-rate of 512 kbps or 384 kbps for 5.1 channels, the Spatial Audio Codec aims to achieve a quite low bit-rate of 128 kbps, 64 kbps, or further 48 kbps, in order to compress and code the multiple-channel signals (see Non-Patent Reference 1, for example).

FIG. 1 is a block diagram showing a structure of the conventional audio apparatus.

The audio apparatus 1000 includes an audio encoder 1100 and an audio decoder 1200. The audio encoder 1100 performs spatial audio coding for a group of audio signals and outputs the coded signals. The audio decoder 1200 decodes the coded signals.

The audio encoder 1100 processes audio signals (audio signals L and R of two channels, for example) in units of frames, called 1024-sample, 2048-sample, or the like. The audio encoder 1100 includes a down-mix unit 1110, a binaural cue detection unit 1120, an encoder 1150, and a multiplexing unit 1190.

The down-mix unit 1110 generates a down-mixed signal M in which audio signals L and R of two channels that are expressed as spectrums are down-mixed, by calculating an average of the audio signals L and R of two channels that are expressed as spectrums, in other words, by calculating M=(L+R)/2.

The binaural cue detection unit 1120 generates binaural cue (BC) information by comparing the down-mixed signal M and the audio signals L and R for each spectrum band. The BC information is used to reproduce the audio signals L and R from the down-mixed signal.

The BC information includes: level information IID representing inter-channel level/intensity difference; correlation information ICC representing inter-channel coherence/correlation; and phase information IPD representing inter-channel phase/delay difference.

Here, the correlation information ICC represents similarity between the two audio signals L and R. On the other hand, the level information IID represents relative intensity of the audio signals L and R. In general, the level information IID is information for controlling balance and localization of audio, and the level information IID is information for controlling width and diffusion of audio. Both of the information are spatial parameters to help listeners to imagine auditory scenes.

The audio signals L and R and the down-mixed signal M which are expressed as spectrums are generally sectionalized into a plurality of areas including "parameter bands". Therefore, the BC information is calculated for each of the parameter bands. Note that hereinafter the "BC information" and "spatial parameter" are often used synonymously with each other.

The encoder 1150 compresses and codes the down-mixed signal M, according to, for example, MPEG Audio Layer-3 (MP3), Advanced Audio Coding (AAC), or the like.

The multiplexing unit 1190 multiplexes the down-mixed signal M and quantized BC information to generate a bitstream, and outputs the bitstream as the above-mentioned coded signals.

The audio decoder 1200 includes an inverse-multiplexing unit 1210, a decoder 1220, and a multiple-channel synthesis unit 1240.

The inverse-multiplexing unit 1210 obtains the above-mentioned bitstream, divides the bitstream into the quantized BC information and the coded down-mixed signal M, and outputs the resulting BC information and down-mixed signal M. Note that the inverse-multiplexing unit 1210 inversely quantizes the quantized BC information, and outputs the resulting BC information.

The decoder 1220 decodes the coded down-mixed signal M, and outputs the decoded down-mixed signal M to the multiple-channel synthesis unit 1240.

The multiple-channel synthesis unit 1240 obtains the down-mixed signal M from the decoder 1220, and the BC information from the inverse-multiplexing unit 1210. Then, the multiple-channel synthesis unit 1240 reproduces two audio signals L and R from the down-mixed signal M, using the BC information.

Although it has been described that the audio apparatus 1000 codes and decodes audio signals of two channels as one example, the audio apparatus 1000 is able to code and decode audio signals of more than two channels (audio signals of six channels forming 5.1-channel sound source, for example).

FIG. 2 is a block diagram showing a functional structure of the multiple-channel synthesis unit 1240.

For example, in the case where the multiple-channel synthesis unit 1240 divides the down-mixed signal M into audio signals of six channels, the multiple-channel synthesis unit 1240 includes the first dividing unit 1241, the second dividing unit 1242, the third dividing unit 1243, the fourth dividing unit 1244, and the fifth dividing unit 1244. Note that in the down-mixed signal M, a center audio signal C, a left-front audio signal $L_f$, a right-front audio signal $R_f$, a left-side audio signal $L_5$, a right-side audio signal $R_s$, and a low frequency audio signal LFE are down-mixed. The center audio signal C is for a loudspeaker positioned on the center front of a listener. The left-front audio signal $L_f$ is for a loudspeaker positioned on the left front of the listener. The right-front audio signal $R_f$ is for a loudspeaker positioned on the right front of the listener. The left-side audio signal $L_s$ is for a loudspeaker positioned on the left side of the listener. The right-side audio signal $R_s$ is for a loudspeaker positioned on the right side of the listener. The low frequency audio signal LFE is for a sub-woofer loudspeaker for low sound outputting.

The first dividing unit 1241 divides the down-mixed signal M into the first down-mixed signal $M_1$ and the fourth down-mixed signal $M_4$ in order to be outputted. In the first down-mixed signal $M_1$, the center audio signal C, the left-front audio signal $L_f$, the right-front audio signal $R_f$, and the low frequency audio signal LFE are down-mixed. In the fourth down-mixed signal $M_4$, the left-side audio signal $L_s$ and the right-side audio signal $R_s$ are down-mixed.

The second dividing unit 1242 divides the first down-mixed signal $M_1$ into the second down-mixed signal $M_2$ and the third down-mixed signal $M_3$ in order to be outputted. In the second down-mixed signal $M_2$, the left-front audio signal $L_f$ and the right-front audio signal $R_f$ are down-mixed. In the third down-mixed signal $M_3$, the center audio signal C and the low frequency audio signal LFE are down-mixed.

The third dividing unit 1243 divides the second down-mixed signal $M_2$ into the left-front audio signal $L_f$ and the right-front audio signal $R_f$ in order to be outputted.

The fourth dividing unit 1244 divides the third down-mixed signal $M_3$ into the center audio signal C and the low frequency audio signal LFE in order to be outputted.

The fifth dividing unit 1245 divides the fourth down-mixed signal $M_4$ into the left-side audio signal $L_s$ and the right-side audio signal $R_s$ in order to be outputted.

As described above, in the multiple-channel synthesis unit 1240, each of the dividing units divides one signal into two signals using a multiple-stage method, and the multiple-channel synthesis unit 1240 recursively repeats the signal dividing until the signal are eventually divided into a plurality of single audio signals.

FIG. 3 is a block diagram showing another functional structure of the multiple-channel synthesis unit 1240.

The multiple-channel synthesis unit 1240 includes an all-pass filter 1261, an arithmetic unit 1262, and a Binaural Cue Coding (BCC) processing unit 1263.

The all-pass filter 1261 obtains the down-mixed signal M, generates a decorrelated signal $M_{rev}$ which is not correlated with the down-mixed signal M, and outputs the decorrelated signal $M_{rev}$. Note that the down-mixed signal M and the decorrelated signal $M_{rev}$ are considered to be "incoherent with each other", if these signals are auditorily compared to each other. Note also that the decorrelated signal $M_{rev}$ has the same energy as the down-mixed signal M, including finite-time reverberation components that provide auditory hallucination as if sounds were spread.

The BCC processing unit 1263 obtains the BC information, and generates a mixing coefficient $H_{ij}$ based on the level information IID, the correlation information ICC, and the like which are included in the BC information, and then outputs the generated mixing coefficient $H_{ij}$.

The arithmetic unit 1262 obtains the down-mixed signal M, the decorrelated signal $M_{rev}$, and the mixing coefficient $H_{ij}$, then performs arithmetic operation using them according to the following equation 1, and eventually outputs the audio signals L and R. As described above, using the mixing coefficient $H_{ij}$, it is possible to set a degree of correlation between the audio signals L and R, and directional characteristics of the audio signals, to the desired states.

$$L=H_{11}\times M+H_{12}\times M_{rev}$$

$$R=H_{21}\times M+H_{22}\times M_{rev} \quad \text{[equation 1]}$$

FIG. 4 is a block diagram showing a more detailed structure of the multiple-channel synthesis unit 1240.

The multiple-channel synthesis unit 1240 includes a pre-matrix processing unit 1251, a post-matrix processing unit 1252, the first arithmetic unit 1253, the second arithmetic unit 1255, a decorrelater 1254, an analysis filter bank 1256, and a synthesis filter bank 1257. Note that the pre-matrix processing unit 1251, the post-matrix processing unit 125, the first arithmetic unit 1253, the second arithmetic unit 1255, and the decorrelater 1254 form a channel expansion unit 1270.

The analysis filter bank 1256 obtains the down-mixed signal M from the decoder 1220, then converts an expression format of the down-mixed signal M into a time/frequency hybrid expression, and eventually outputs the signal as the first frequency band signal x. Note that this analysis filter bank 1256 has the first stage and the second stage. For example, the first stage and the second stage are a Quadrature Mirror Filter (QMF) filter bank and a Nyquist filter bank, respectively. Regarding these stages, the QMF filter (first stage) divides a spectrum into a plurality of frequency bands, and then the Nyquist filter (second stage) divides a sub-band of low frequency into finer sub-bands, thereby improving resolution of a spectrum in the low-frequency sub-band.

The pre-matrix processing unit 1251 generates a matrix $R_1$ using the BC information. The matrix $R_1$ is a scaling factor that indicates scaling of signal intensity level for each channel.

For example, the pre-matrix processing unit 1251 generates the matrix $R_1$, using the level information IID that represent a ration of a signal intensity level of the down-mixed signal M to each signal intensity level of the first down-mixed signal $M_1$, the second down-mixed signal $M_2$, the third down-mixed signal $M_3$, the fourth down-mixed signal $M_4$.

The first arithmetic unit 1253 obtains from the analysis filter bank 1256 the first frequency band signal x expressed by time/frequency hybrid, and multiplies the first frequency band signal x by the matrix $R_1$ according to the following equations 2 and 3, for example. Then, the first arithmetic unit 1253 outputs an intermediate signal v that represents the result of the above matrix arithmetic operation. In other words, the first arithmetic unit 1253 separates four down-mixed signals $M_1$ to $M_4$ from the first frequency band signal x expressed by time/frequency hybrid outputted from the analysis filter bank 1256.

$$v=\begin{bmatrix} M \\ M_1 \\ M_2 \\ M_3 \\ M_4 \end{bmatrix}=R_1x=R_1[M] \quad \text{[equation 2]}$$

$$\begin{aligned} M_1 &= L_f+R_f+C+LFE \\ M_2 &= L_f+R_f \\ M_3 &= C+LFE \\ M_4 &= L_s+R_s \end{aligned} \quad \text{[equation 3]}$$

The decorrelater 1254 has a function as the all-pass filter 1261 shown in FIG. 3, and performs all-pass filter processing for the intermediate signal v, thereby generating and outputting a decorrelated signal w according to the following equation 4. Note that factors $M_{rev}$ and $M_{i,rev}$ in the decorrelated signal w are signals obtained by performing decorrelation processing for the down-mixed signal M and $M_i$.

$$w=\begin{bmatrix} M \\ decorr(v) \end{bmatrix}=\begin{bmatrix} M \\ M_{rev} \\ M_{1,rev} \\ M_{2,rev} \\ M_{3,rev} \\ M_{4,rev} \end{bmatrix} \quad \text{[equation 4]}$$

The post-matrix processing unit 125 generates a matrix $R_2$ using the BC information. The matrix $R_2$ represents scaling of reverberation for each channel. For example, the post-matrix processing unit 1252 derives the mixing coefficient $H_{ij}$ from the correlation information ICC which represents width and diffusion of sound, and then generates the matrix $R_2$ including the mixing coefficient $H_{ij}$.

The second arithmetic unit 1255 multiplies the decorrelated signal w by the matrix $R_2$, and outputs an output signal y which represents the result of the matrix arithmetic operation. In other words, the second arithmetic unit 1255 separates six audio signals $L_f$, $R_f$, $L_s$, $R_s$, C, and LFE from the decorrelated signal w.

For example, as shown in FIG. 2, since the left-front audio signal $L_f$ is divided from the second down-mixed signal $M_2$, the dividing of the left-front audio signal $L_f$ needs the second down-mixed signal $M_2$ and a factor $M_{2,rev}$ of a decorrelated signal w corresponding to the second down-mixed signal $M_2$. Likewise, since the second down-mixed signal $M_2$ is divided from the first down-mixed signal $M_1$, the dividing of the second down-mixed signal $M_2$ needs the first down-mixed signal $M_1$ and a factor $M_{1,rev}$ of a decorrelated signal w corresponding to the first down-mixed signal $M_1$.

Therefore, the left-front audio signal $L_f$ is expressed by the following equation 5.

$$L_f=H_{11,A}\times M_2+H_{11,A}\times M_{2,rev}$$

$$M_2=H_{11,D}\times M_1+H_{12,D}\times M_{1,rev}$$

$$M_2=H_{11,E}\times M+H_{12,E}\times M_{2,rev} \quad \text{[equation 5]}$$

Here, in the equation 5, $H_{ij,A}$ is a mixing coefficient in the third dividing unit 1243, $H_{ij,D}$ is a mixing coefficient in the second dividing unit 1242, and $H_{ij,E}$ is a mixing coefficient in the first dividing unit 1241. The three expressions in the equation 5 is able to be expressed as a single vector multiplication expression.

$$L_f=[H_{11,A}H_{11,D}H_{11,E}H_{11,A}H_{11,D}H_{12,E}H_{11,A}H_{12,D} \; H_{12,A}00]w=R_{2,LF}w \quad \text{[equation 6]}$$

Each of the audio signals Rf, C, LFE, Ls, and Rs other than the left-front audio signal Lf is calculated by multiplication of the above-mentioned matrix by a matrix of the decorrelated signal w. That is, an output signal y is expressed by the following equation 7.

$$y=\begin{bmatrix} L_f \\ R_f \\ L_s \\ R_s \\ C \\ LFE \end{bmatrix}=\begin{bmatrix} R_{2,LF} \\ R_{2,RF} \\ R_{2,LS} \\ R_{2,RS} \\ R_{2,C} \\ R_{2,LFE} \end{bmatrix}w=R_2w \quad \text{[equation 7]}$$

The synthesis filter bank 1257 converts the expression format of each of the reproduced audio signals, from the time/frequency hybrid expression to the time expression, and then outputs the plurality of audio signals in the time expression as multiple-channel signals. Note that the synthesis filter bank 1257 includes, for example, two stages, so that the synthesis filter bank 1257 matches with the analysis filter bank 1256. Note also that the matrixes $R_1$ and $R_2$ are generated as matrixes $R_1(b)$ and $R_2(b)$, respectively, for each of the above-mentioned parameter bands b.

FIG. 5 is a block diagram showing a structure of the audio decoder 1200.

In FIG. 5, Note that double-lined arrows show flow of frequency band signals (the above-mentioned first frequency band signal x and output signal y) which are divided as a plurality of frequency bands.

In a coded signal obtained by the inverse-multiplexing unit 1210, (i) a coded down-mixed signal in which audio signals of six channels are down-mixed to a down-mixed signal M of two channels and coded and (ii) quantized BC information are multiplexed.

The inverse-multiplexing unit 1210 divides the coded signal into the coded down-mixed signal and the BC information. The coded down-mixed signal is coded data of two channels which is coded according to, for example, the AAC method of the MPEG standard.

The decoder 1220 decodes the coded down-mixed signal by an ACC decoder. As a result, the decoder 1220 outputs a down-mixed signal M that is a Pulse Code Modulation (PCM) signal (time-axis signal) of two channels.

The analysis filter bank 1256 has two analysis filters 1256*a*, each of which converts the down-mixed signal M outputted from the decoder 1220, into the first frequency band signal x.

The channel expansion unit 1270 expands the first frequency band signal x of two channels into the output signal y of six channels, using the BC information (see Patent Reference 1, for example).

The synthesis filter bank 1257 has six synthesis filters 1257*a*, each of which converts the output signal y outputted from the channel expansion unit 127, into an audio signal that is a PCM signal.

FIG. 6 is a block diagram showing another structure of the audio decoder 1200.

In a coded signal obtained by the inverse-multiplexing unit 1210, (i) a coded down-mixed signal in which audio signals of six channels are down-mixed to a down-mixed signal M of one channel and coded and (ii) quantized BC information are multiplexed.

In the above case, the decoder 1220 decodes the coded down-mixed signal by, for example, an ACC decoder. As a result, the decoder 1220 outputs a down-mixed signal M that is a PCM signal (time-axis signal) of one channel.

The analysis filter bank 1256 has one analysis filter 1256*a* which converts the down-mixed signal M outputted from the decoder 1220, into the first frequency band signal x.

The channel expansion unit 1270 expands the first frequency band signal x of one channel into the output signal y of six channels, using the BC information.

[Non-Patent Reference 1] 118th AES convention, Barcelona, Spain, 2005, Convention Paper 6447

[Patent Reference 1] Japanese Patent Application Publication No. 2004-248989

DISCLOSURE OF INVENTION

Problems that Invention is to Solve

However, there is a problem that the above-described conventional audio decoder has a large circuit size due to a large amount of arithmetic operations.

More specifically, the frequency band signals (the first frequency band signal x and the output signal y) shown by the double-lined arrows in FIGS. 5 and 6 are represented by complex numbers, so that processing in the analysis filter bank 1256, the channel expansion unit 1270, and the synthesis filter bank 1257 requires a large amount of arithmetic operations and a large memory size.

Therefore, it has been considered to process the frequency band signals represented by complex numbers, as real numbers. However, if the processing for complex numbers is merely replaced by processing for real numbers, aliasing noise sometimes occurs. More specifically, when signals having high tonality (high-tone signals) exist in a specific frequency band, aliasing noise occurs in a frequency band adjacent to the specific frequency band due to processing of the analysis filter 1257*a* as real number processing. Therefore, it has been considered that it is detected whether or not such a high-tone signal exists in each frequency band, and if such a signal exists, then processing for canceling aliasing noise is performed prior to the processing of the analysis filter 1257*a*.

FIG. 7 is a block diagram showing a structure of an audio decoder which performs the real number processing and the aliasing noise cancellation.

In the audio decoder 1200', each of the analysis filter bank 1256, the channel expansion unit 127, and the synthesis filter bank 1257 treats frequency band signals (first frequency band signal x and output signal y) as real numbers. Then, this audio decoder 1200' has an aliasing noise detection unit 1281 and six noise cancellation units 1282.

Based on the first frequency band signal x, the aliasing noise detection unit 1281 detects whether or not a high-tone signal exists in each of frequency bands in the signal, in other words, whether or not there is a possibility of occurrence of aliasing noise.

Based on the detection results of the aliasing noise detection unit 1281, each of the six noise cancellation units 1281 cancels aliasing noise from the output signals y which are outputted from the channel expansion unit 1270.

However, this kind of audio decoder needs the noise cancellation units 1281 whose number corresponds to the number of channels of the output signal y, so that the replacement of complex number processing by real-number processing does not have any advantages but results in a large arithmetic amount which increases the circuit size.

Thus, in view of the above problems, an object of the present invention is to provide an audio decoder which can reduce an arithmetic amount while occurrence of aliasing noise is suppressed.

Means to Solve the Problems

In order to achieve the above object, the audio decoder according to the present invention decodes a bitstream to generate audio signals of N channels, where N is equal to or larger than 2, the bitstream including a first coded data and a second coded data, the first coded data being generated by coding a down-mixed signal obtained by down-mixing the audio signals of the N channels, and the second coded data being generated by coding a parameter to be used to restore the down-mixed signals into the original audio signals of the N channels. The audio decoder includes: a frequency band signal generation unit operable to generate a first frequency band signal from the first coded data, the first frequency band signal corresponding to the down-mixed signal; a channel expansion unit operable to convert the first frequency band signal into second frequency band signals using the second coded data, the first frequency band signal being generated by the frequency band signal generation unit, and the second frequency band signals corresponding to the respective audio signals of the N channels; a band synthesis unit operable to perform band synthesis for the second frequency band signals of the N channels which are generated by the channel expansion unit, thereby converting the second frequency band signals into the audio signals of the N channels, the audio signals being expressed on a time axis; and an aliasing noise detection unit operable to detect occurrence of an aliasing noise in the first frequency band signal, wherein the channel expansion unit is operable to suppress the aliasing noise from being included in the second frequency band signals, based on information detected by the aliasing noise detection unit.

Thereby, when it is predicted that aliasing noise will occur in the first frequency band signal, the channel expansion unit suppresses the noise occurrence. As a result, the aliasing noise is suppressed using a much smaller amount of processing, in comparison with the apparatus in which the last stage of the channel expansion unit has noise cancellation units for respective channels. This realizes an audio decoder having a small circuit size or a program size.

Further, the frequency band signal generation unit may be operable to generate the first frequency band signal which is expressed by a real number, regarding at least a part of frequency bands of the first frequency band signals, and the aliasing noise detection unit may be operable to detect the occurrence of the aliasing noise which results from that the first frequency band signal is expressed by the real number.

Thereby, the first frequency band signal is expressed not by a complex number but by a real number. As a result, it is possible to reduce an amount of arithmetic operations, and to prevent the problem of the aliasing noise occurrence due to the use of the real number expression.

Furthermore, the frequency band signal generation unit may include a Nyquist filter bank operable to increase a band resolution for a predetermined frequency band, and the frequency band signal generation unit is operable to (i) generate a frequency band signal expressed by a complex number for a frequency band which is processed by the Nyquist filter bank, and (ii) generate a frequency band signal expressed by a real number for a frequency band which is not processed by the Nyquist filter bank.

Thereby, in a filter bank for improving a band resolution, the first frequency band signal is processed directly as a complex number. As a result, it is possible to reduce an amount of arithmetic operations while maintaining the band resolution with high accuracy, thereby balancing the improvement of sound quality and the reduction of a circuit size.

Still further, the aliasing noise detection unit may be operable to detect a frequency band regarding the first frequency band signal, the frequency band having a signal with a high tonality where a signal level of a frequency component is maintained strong, and the channel expansion unit may be operable to output the second frequency band signal in which a signal level of a frequency band adjacent to the frequency band detected by the aliasing noise detection unit is adjusted.

Thereby, the signal level is adjusted in the frequency band having the high tonality where aliasing noise is noticed. As a result, efficient noise cancellation is realized.

Still further, the second coded data may be data generated by coding a spatial parameter which includes a level ratio and a phase difference between the original audio signals of the N channels, and the channel expansion unit may include: an arithmetic operation unit operable to generate the second frequency band signal, by mixing the first frequency band signal and a decorrelated signal by a ratio, the decorrelated signal being generated from the first frequency band signal, and the ratio corresponding to an arithmetic coefficient generated from the spatial parameter; and an adjustment module operable to adjust the signal level by adjusting the arithmetic coefficient, regarding the frequency band adjacent to the frequency band detected by the aliasing noise detection unit.

Thereby, aliasing noise is suppressed while performing auditory hallucination processing for expressing spatial sound spread. As a result, it is possible to realize spatial sound decoding without damaging the spatial sound effects.

Still further, the arithmetic operation unit may include: a pre-matrix module operable to generate an intermediate signal by scaling the first frequency band signal, using, as a part of the arithmetic coefficient, a scaling coefficient which is derived from the level ratio included in the spatial parameter; a decorrelation module operable to generate the decorrelated signal, by performing all-pass filtering for the intermediate signal generated by the pre-matrix module; and a post-matrix module operable to mix the first frequency band signal and the decorrelated signal, using, as a part of the arithmetic coefficient, a mixing coefficient which is derived from the phase difference included in the spatial parameter, and the adjustment module is operable to adjust the arithmetic coefficient by adjusting the spatial parameter.

Thereby, the present invention is able to be applied for the conventional spatial sound decoder having the pre-matrix module, the decorrelation module, and the post-matrix module. As a result, down-sizing and high-speed processing become possible.

Note that the present invention is able to be realized as not only the above audio decoder, but also an integrated circuit, a method, a program, and a recording medium in which the program is stored, corresponding to the audio decoder.

Effects of the Invention

The audio decoder according to the present invention has advantages of reducing an amount of arithmetic operations and at the same time suppress occurrence of aliasing noise.

NUMERICAL REFERENCES

Figure 1:
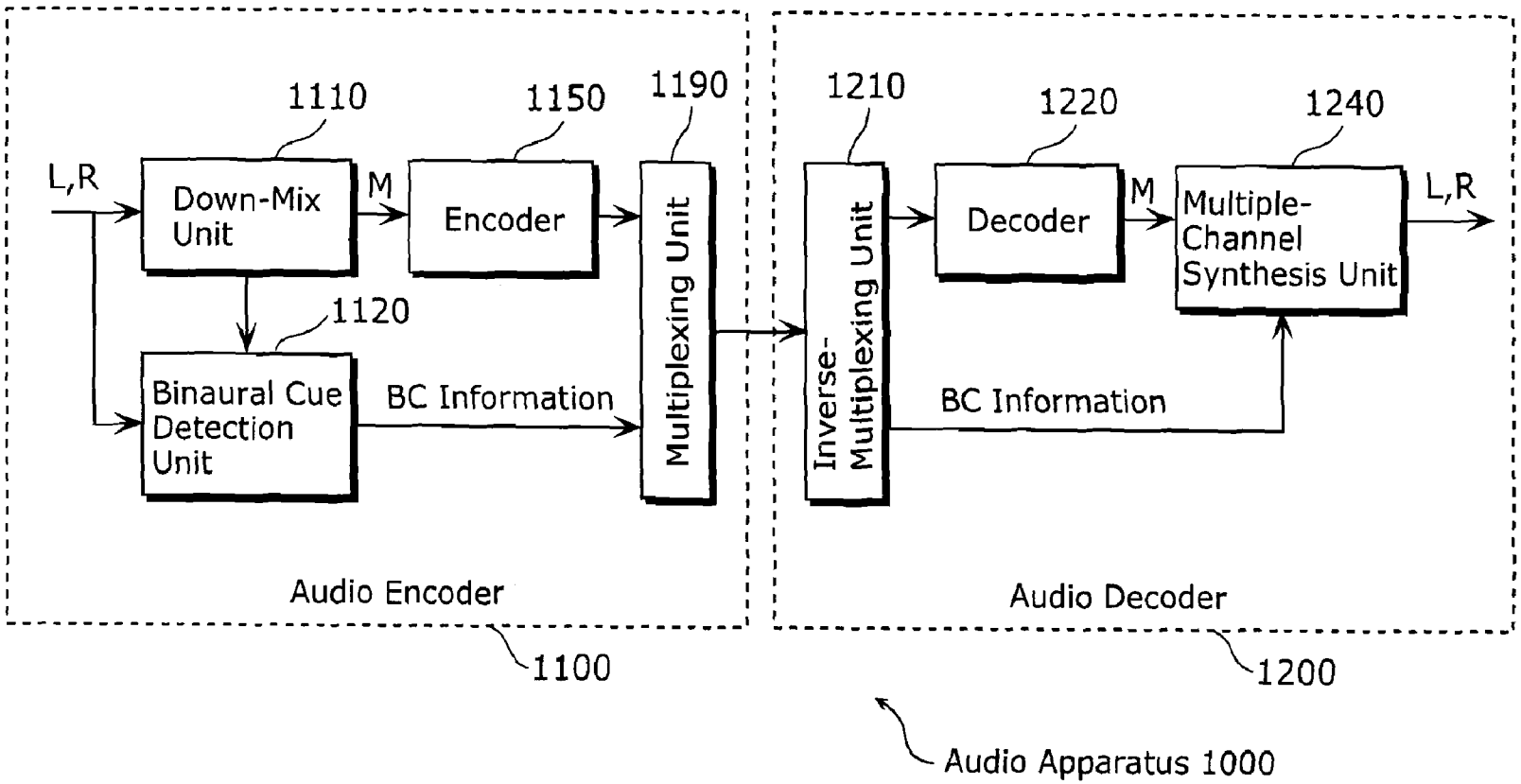
FIG. 1 PRIOR ART
FIG. 1 is a block diagram showing a structure of the conventional audio device.
Figure 2:
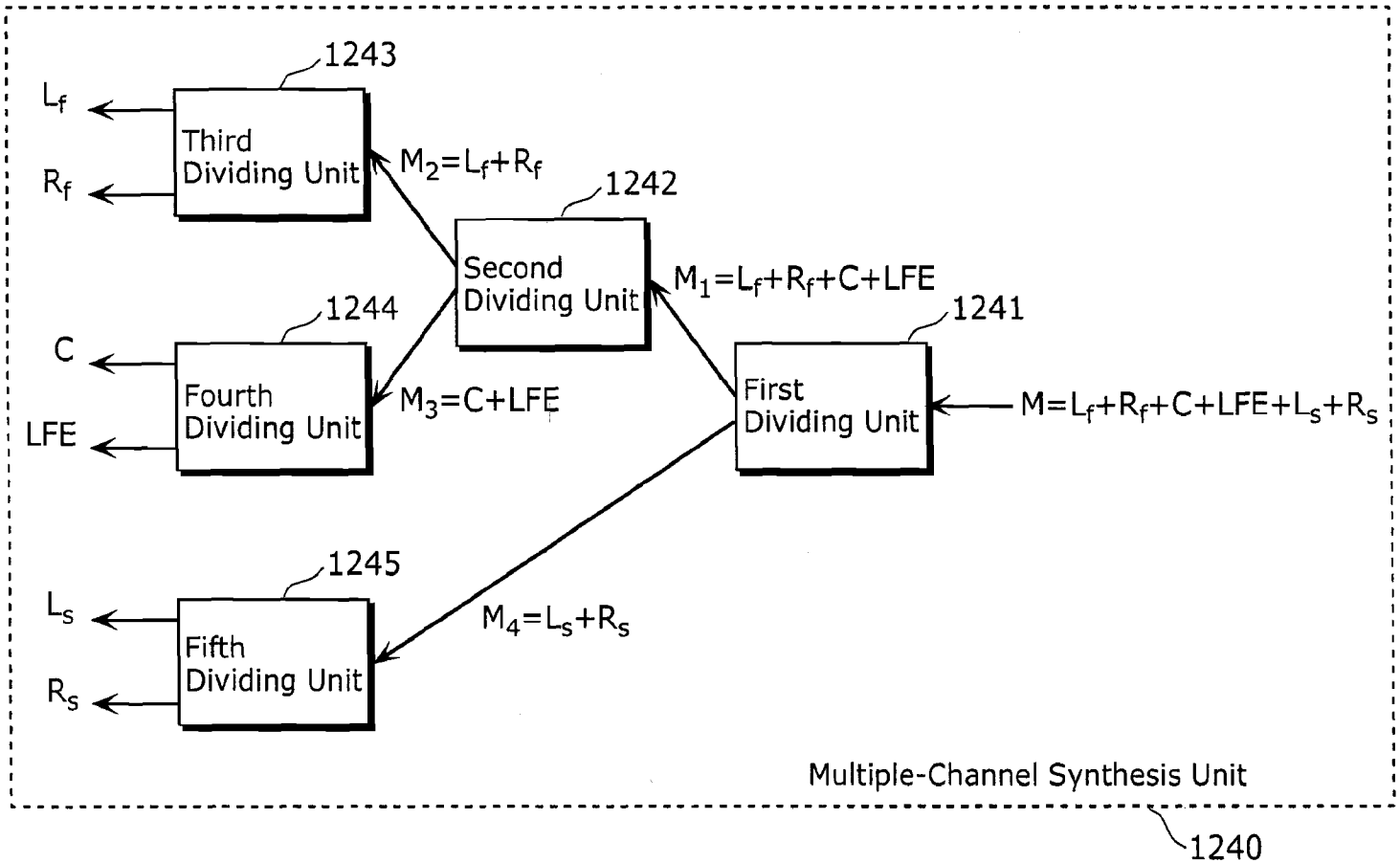
FIG. 2 PRIOR ART
FIG. 2 is a block diagram showing a functional structure of the multiple-channel synthesis unit.
Figure 3:
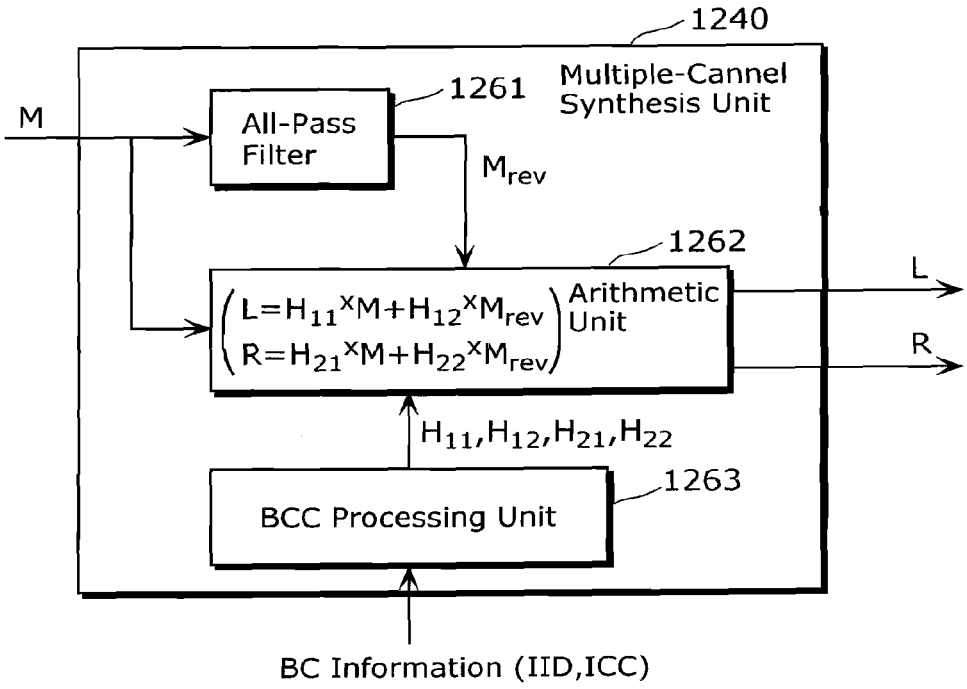
FIG. 3 PRIOR ART
FIG. 3 is a block diagram showing another functional structure of the multiple-channel synthesis unit.
Figure 4:
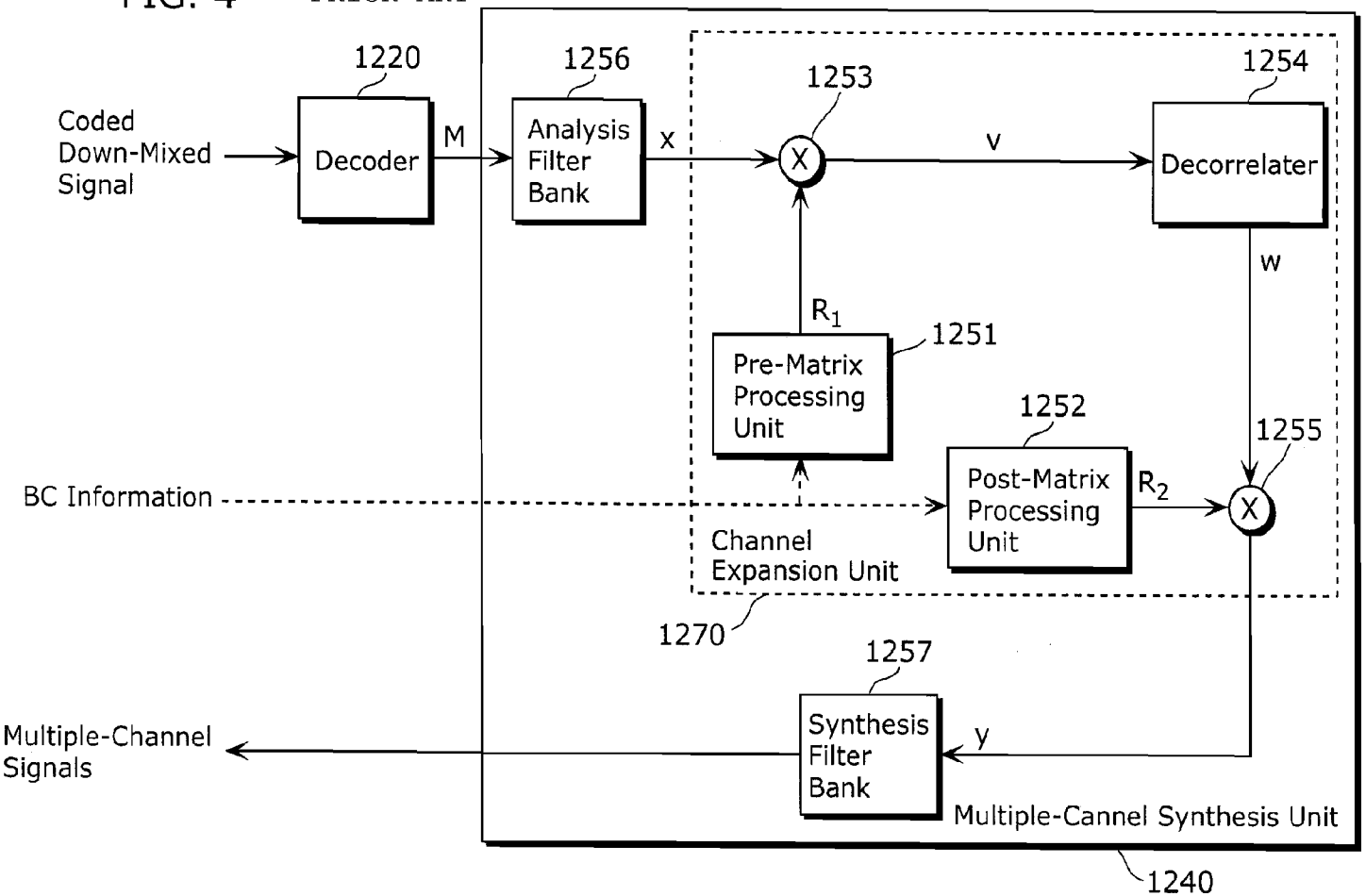
FIG. 4 PRIOR ART
FIG. 4 is a block diagram showing a more detailed structure of the multiple-channel synthesis unit.
Figure 5:
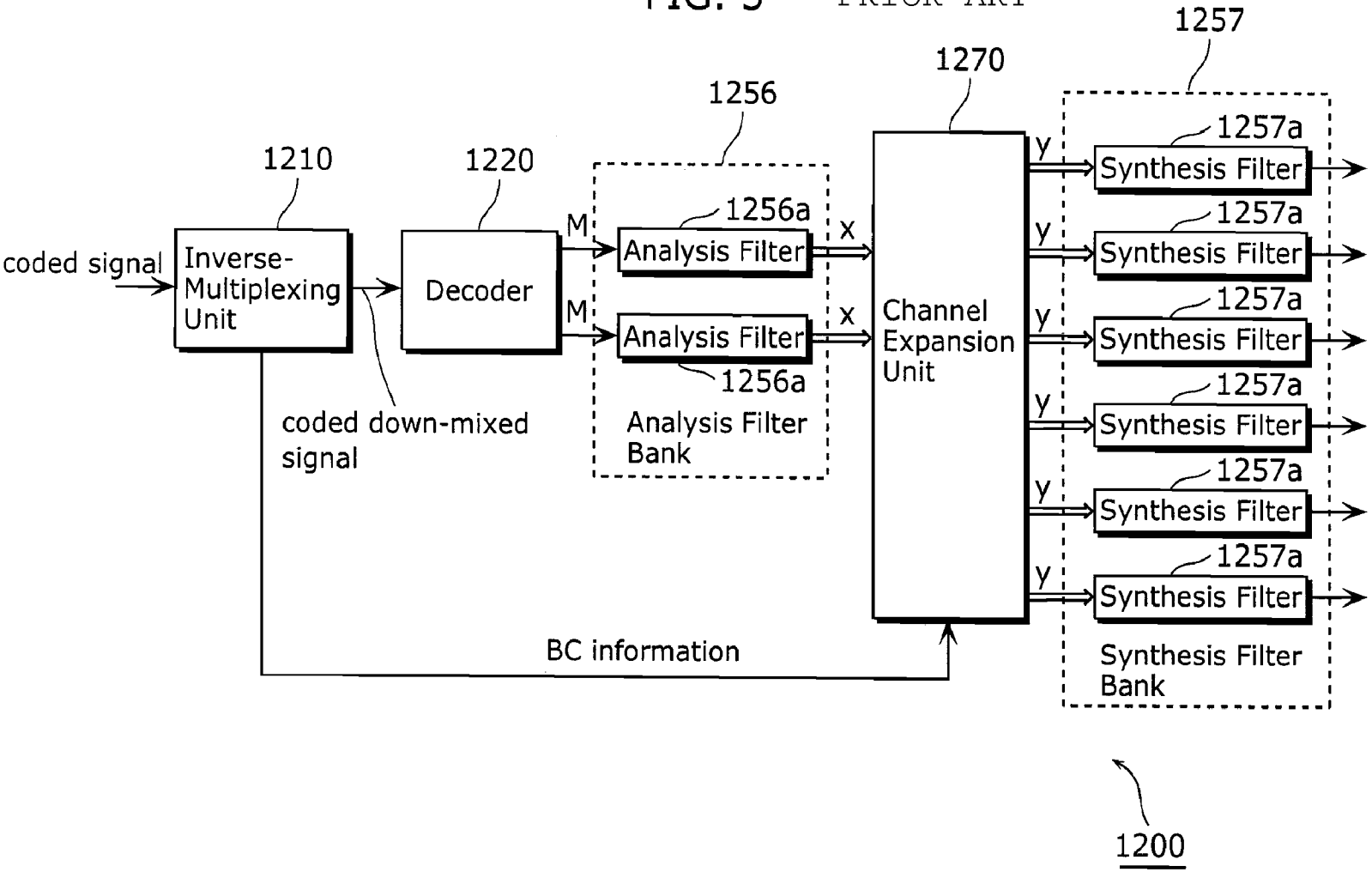
FIG. 5 PRIOR ART
FIG. 5 is a block diagram showing another structure of the conventional audio decoder.
Figure 6:
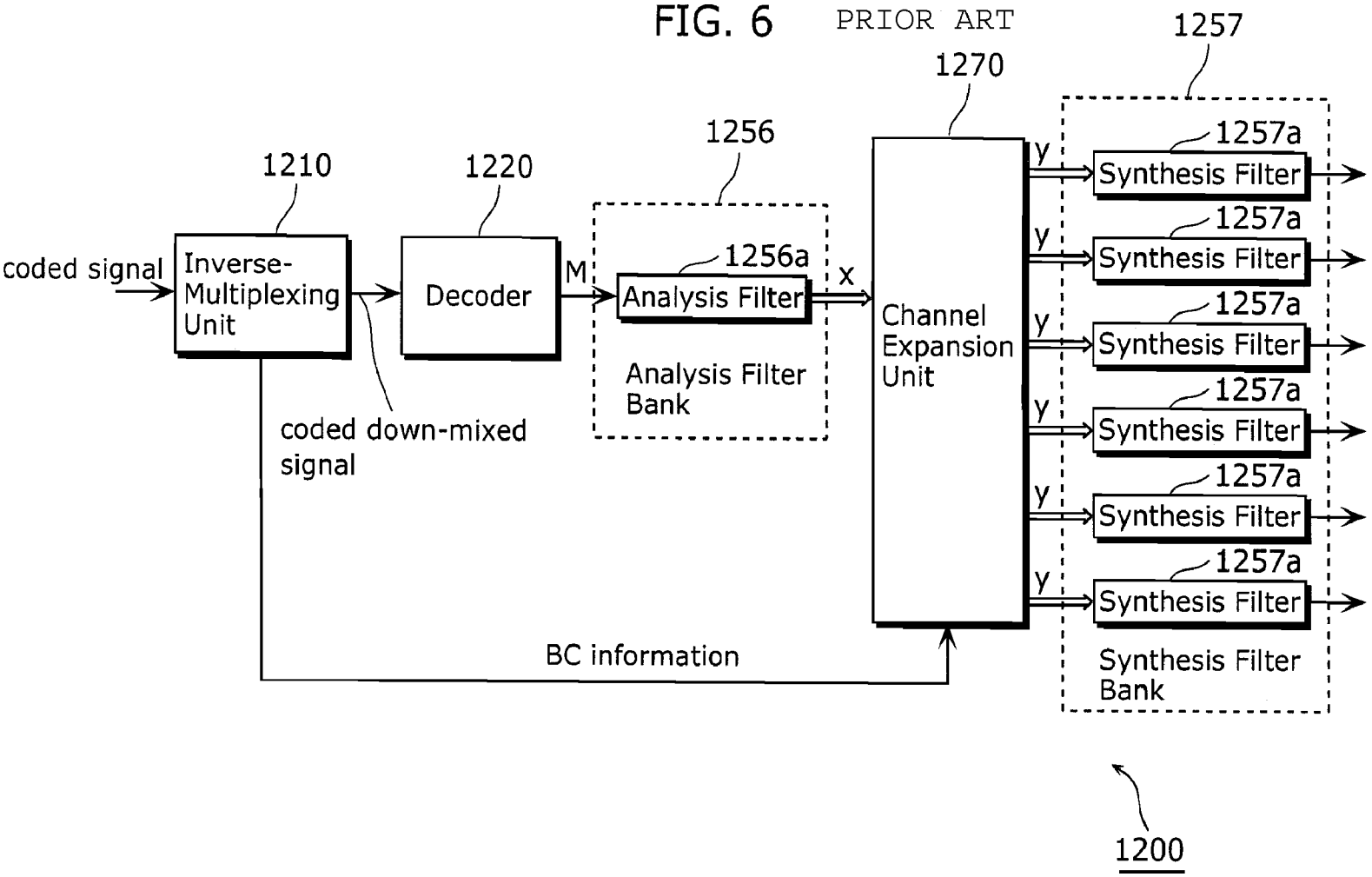
FIG. 6 PRIOR ART
FIG. 6 is a block diagram showing still another structure of the conventional audio decoder.
Figure 7:
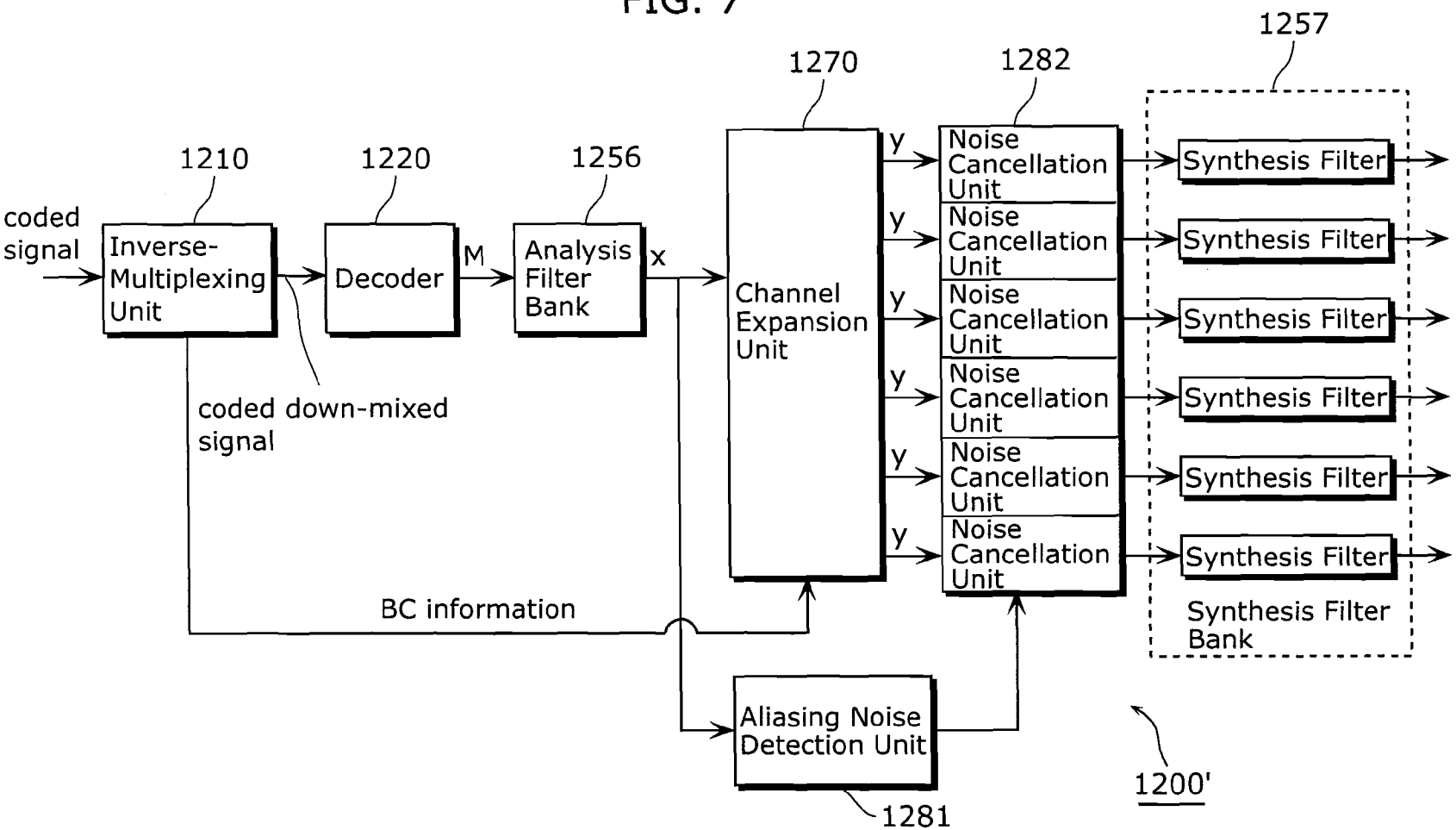
FIG. 7 is a block diagram showing a structure of an audio decoder which performs real number processing and aliasing noise cancellation.

100 audio decoder
101 inverse-multiplexing unit
102 decoder
103 multiple-channel synthesis unit
110 analysis filter bank
120 aliasing noise cancellation unit (TD unit)
130 channel expansion unit
131 pre-matrix processing unit
132 post-matrix processing unit
133 first arithmetic unit
134 second arithmetic unit
135 real number decorrelater unit
136 EQ unit
140 analysis filter bank

BEST MODE FOR CARRYING OUT THE INVENTION

The following describes an audio decoder according to the embodiment of the present invention with reference to the drawings.

Figure 8:
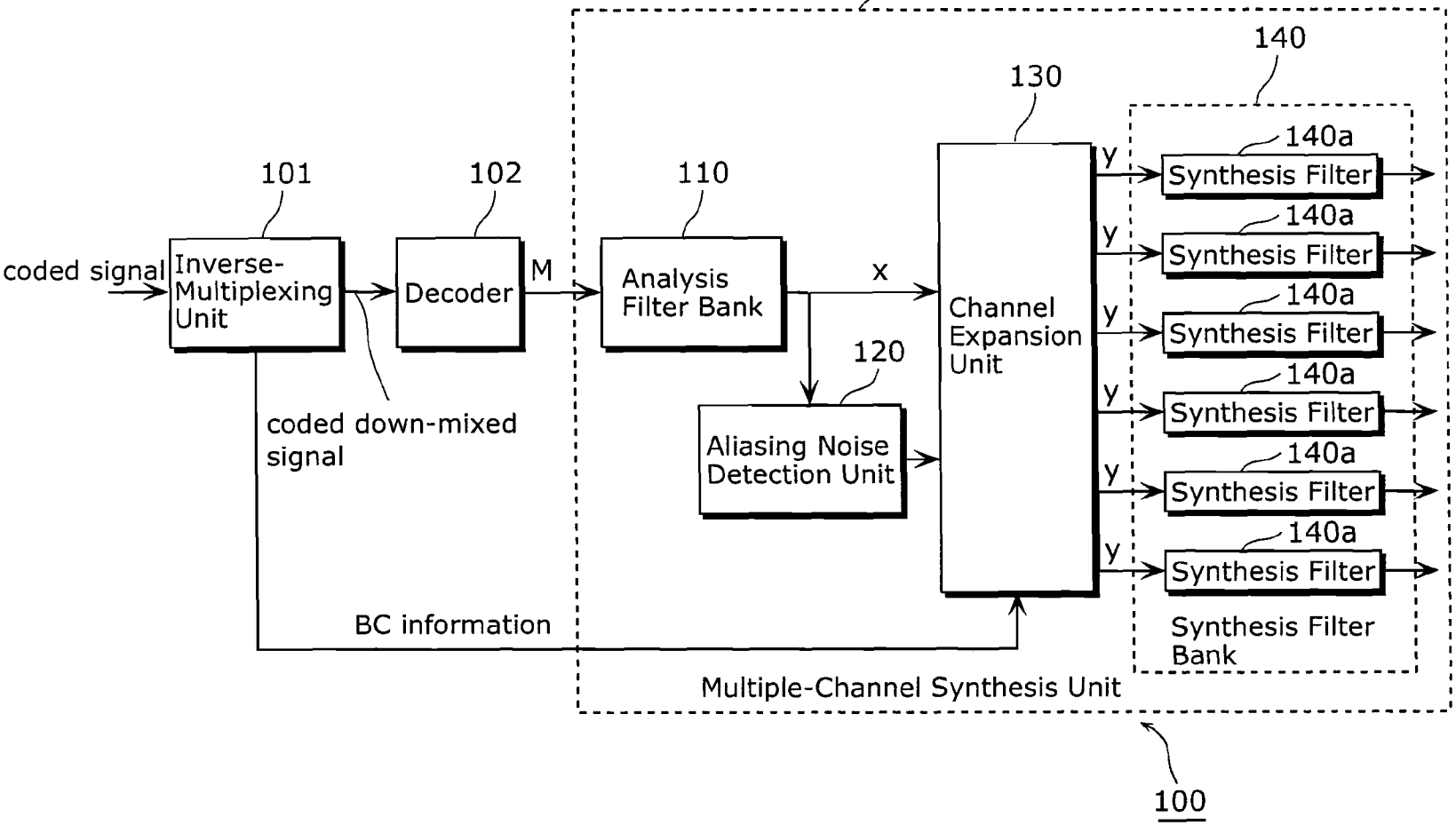
FIG. 8 is a block diagram of a structure of an audio decoder according to an embodiment of the present invention.

FIG. 8 is a block diagram of a structure of the audio decoder according to the embodiment of the present invention.

The audio decoder 100 according to the present embodiment reduces an amount of arithmetic operations and at the same time suppresses occurrence of aliasing noise. The audio decoder 100 includes an inverse-multiplexing unit 101, a decoder 102, and a multiple-channel synthesis unit 103.

The inverse-multiplexing unit 101, which has the same functions as the conventional inverse-multiplexing unit 1210, obtains coded signal from an audio encoder and divide the coded signal into quantized BC information and coded down-mixed signals, in order to be outputted. Note that the inverse-multiplexing unit 101 inversely quantizes the quantized BC information, and outputs the resulting BC information.

The coded down-mixed signal is structured as the first coded data. For example, the coded down-mixed signal is generated by down-mixing audio signals of six channels and coding the down-mixed signal by the AAC method. Note that the coded down-mixed signal may be coded by both of the AAC method and a spectral band replication method. The BC information is coded in a predetermined format, and structured as the second coded data.

The decoder 102, which has the same function as the conventional decoder 1220, generates a down-mixed signal M which is a PCM signal (time axis signal) by decoding the coded down-mixed signal, and outputs the generated down-mixed signal M to the multiple-channel synthesis unit 103. Note that the decoder 102 may generate the frequency band signal, by converting a modified discrete cosine transform (MDCT) coefficient which is generated during coding in the AAC method, according to the output format of the analysis filter bank 110.

The multiple-channel synthesis unit 103 obtains the down-mixed signal M from the decoder 102 and also obtains the BC information from the inverse-multiplexing unit 101. Then, the multiple-channel synthesis unit 103 reproduces the above-mentioned six audio signals from the down-mixed signal M, using the BC information.

The multiple-channel synthesis unit 1240 includes an analysis filter bank 110, an aliasing noise detection unit 120, a channel expansion unit 130, and a synthesis filter bank 140.

The analysis filter bank 110 obtains the down-mixed signal M from the decoder 102, then converts an expression format of the down-mixed signal M into a time/frequency hybrid expression, and eventually outputs the signal as the first frequency band signal x. The first frequency band signal x is a frequency band signal whose entire frequency bands are expressed by real numbers. Note that, in the present embodiment, the decoder 102 and the analysis filter bank 110 form a frequency band signal generation unit.

The aliasing noise detection unit 120 detects whether or not there is a high possibility of occurrence of aliasing noise in the audio signals of six channels outputted from the multiple-channel synthesis unit 103, by analyzing the first frequency band signal x outputted from the analysis filter bank 110. In other words, the aliasing noise detection unit 120 determines whether or not there is a high-tone signal in each frequency band of the first frequency band signal x. More specifically, the aliasing noise detection unit 120 detects a frequency band having a high-tone signal where signal levels of some frequency components are maintained strong. Then, if it is determined that such a high-tone signal exists, the aliasing noise detection unit 120 detects that there is a high possibility of occurrence of aliasing noise in frequency bands adjacent to the frequency band having a high-tone signal. Note that the analysis filter bank 110 has a high possibility of the aliasing noise occurrence, since the first frequency band signal x expressed by real numbers is generated in the analysis filter bank 110.

The channel expansion unit 130 obtains the BC information, and generates a matrix for generating an output signal y of six channels from the first frequency band signal x based on the BC information. Here, when the aliasing noise detection unit 120 detects the high possibility of aliasing noise occurrence, the channel expansion unit 130 generates a matrix (arithmetic coefficients) for suppressing the aliasing noise in the output signal y of the synthesis filter bank 140. Then, the channel expansion unit 130 outputs the output signal y of six channels which is frequency band signals (second frequency band signals), by performing matrix arithmetic operations for the first frequency band signal x using the matrix.

This means that, when a high possibility of aliasing noise occurrence is detected, the channel expansion unit 130 adjusts amplitudes of signals in the frequency band having the high possibility, thereby reducing the aliasing noise. More specifically, since BC information includes level information IID, the channel expansion unit 130 obtains a rate of amplification for each frequency band from the level information IID, and adjusts the amplification rate in a matrix, thereby controlling a size of the signal in the frequency band having a high possibility of aliasing noise occurrence.

The synthesis filter bank 140 includes six synthesis filters 140*a*. Each of the synthesis filters 140*a* converts an expression format of each component of the output signal y of the channel expansion unit 130, from a time/frequency hybrid expression into a time expression. More specifically, the synthesis filter 140*a*, which serves as a frequency synthesis unit that performs band synthesis for each component of the output signal y, converts the output signal y that is a frequency band signal into a PCM signal (time axis signal). Thereby, stereo signals including audio signals of six channels are outputted.

Figure 9:
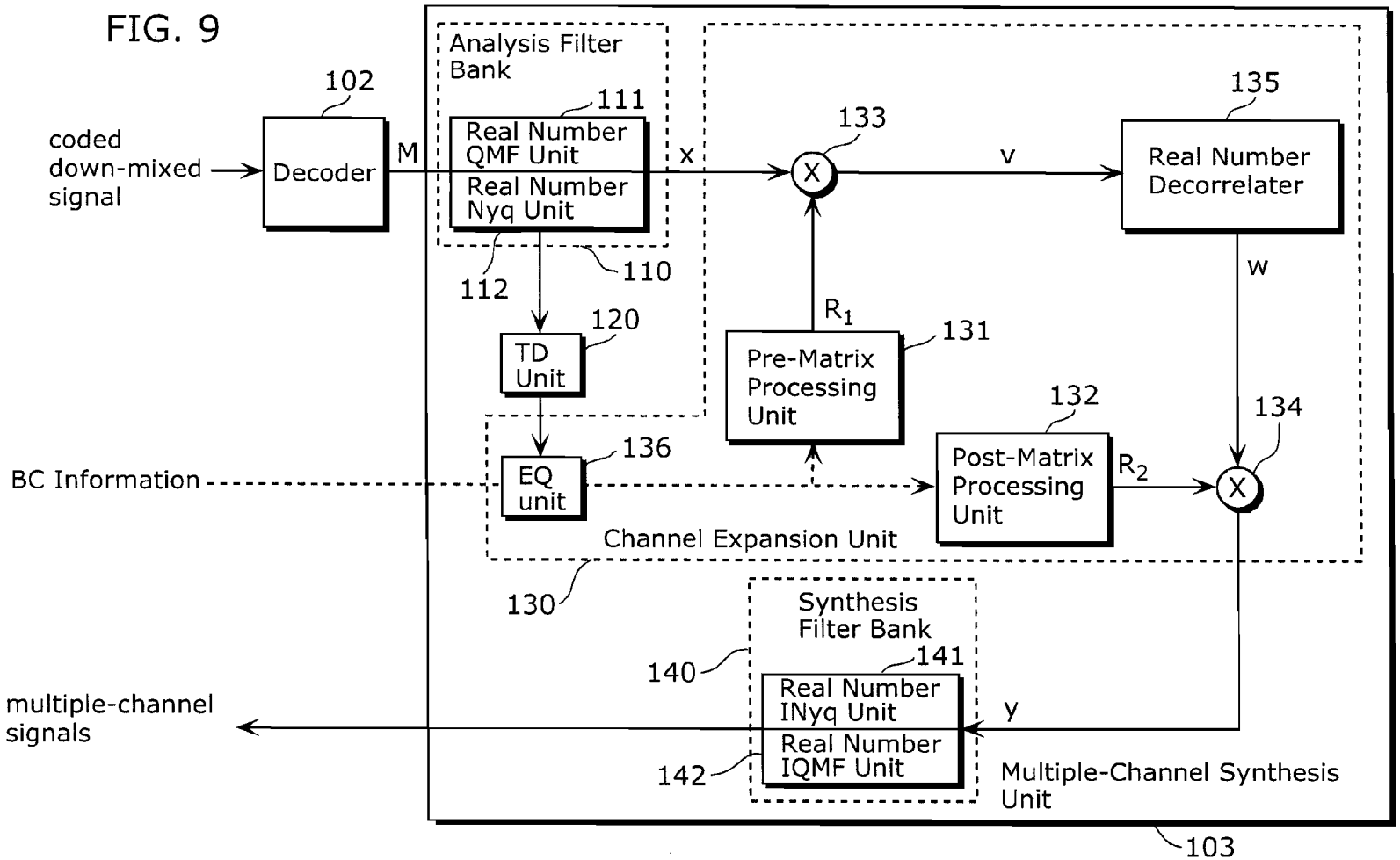
FIG. 9 is a block diagram showing a detailed structure of a multiple-channel synthesis unit.

FIG. 9 is a block diagram showing a detailed structure of the multiple-channel synthesis unit 103.

The analysis filter bank 110 has a real number QMF unit 111 and a real number Nyquist (Nyq) unit 112.

The real number QMF unit 111 includes a quadrature mirror filter (QMF) for real numbers, as a filter bank. The real number QNIF unit 111 analyses a down-mixed signal M, which is a PCM signal, for each predetermined frequency band, and thereby generates the first frequency band signal x of a real number expressed by a time/frequency hybrid expression.

This real number QMF unit 111 uses a real number (real-number modulation coefficient) Mr(k, n) as shown in the following equation 9, not a complex number (complex-number modulation coefficient) Mr(k, n) as shown in the following equation $$M_r(k, n) = 2 \cdot \exp\left(\frac{\pi(k+0.5)(2n-1)}{128}\right) \quad \text{[equation 8]}$$

$$M_r(k, n) = 2 \cdot \cos\left(\frac{\pi(k+0.5)(2n-192)}{128}\right) \quad \text{[equation 9]}$$

The real number Nyq unit 112 includes a Nyquist (Nyq) filter bank for real-number coefficient. The real number QMF unit 111 modifies the first frequency band signal x for each of more segmented frequency bands, for a low frequency band of the first frequency band signal x generated by the real number QMF unit 111.

This filter in the real number Nyq unit 112 uses a real number (real-number modulation coefficient) $g_q^p$ as shown in the following equation 11, not a complex number (complex-number modulation coefficient) $g_q^{n,m}$ as shown in the following equation 10.

$$g_q^{n,m} = h^{Qm}[n]\exp\left(j\frac{2\pi}{Q^m}(q+0.5)(n-6)\right) \quad \text{[equation 10]}$$

$$g_q^p = h^{Qm}[n]\cos\left(\frac{2\pi}{Q^m}(q+0.5)(n-6)\right) \quad \text{[equation 11]}$$

The TD unit 120 is equivalent to the above-mentioned aliasing noise detection unit 120. The TD unit 120 derives tonality $T_g(m)$ of a parameter band m and a processed frame g, according to the following equation 12.

$$T_g(m) = \frac{\left(\sum^{f \subset m} P_g^{pow2}(f) P_g^{coh}(f)\right) + \varepsilon}{\left(\sum^{f \subset m} p_g^{pow2}(f)\right) + \varepsilon} \quad \text{[equation 12]}$$

Here, $P_g^{pow2}(f)$ denotes a sum of signal power consumption in two processed frames g and (g−1). $P_g^{coh}(f)$ denotes a coherence value of these processed frames. A value of $T_g(m)$ ranges from 0 to 1. $T_g(m)=0$ means no tonality. $T_g(m)=1$ means high tonality.

A entire tonality is expressed by the following equation 13, using a minimum value of the above tonality of the two processed frames. A maximum value GT(m) of the parameter band m is expressed by the following equation 14.

$$T(m)=\min(T_g(m)) \quad \text{[equation 13]}$$

$$GT(m)=\max(T_g(m)) \quad \text{[equation 14]}$$

The channel expansion unit 130 includes: an equalizer (EQ) unit 136 as a adjustment module; a pre-matrix processing unit 131; a post-matrix processing unit 132; a first arithmetic unit 133; a second arithmetic unit 134; and a real number decorrelater 135.

When the TD unit 120 detects, in a parameter band b, a high possibility of aliasing noise occurrence, The EQ unit 136 modifies a spatial parameter p(b) of the parameter band b, so that the aliasing noise occurrence is able to be suppressed. Here, the spatial parameter p(b) is level information IID or correlation information ICC included in the BC information.

The pre-matrix processing unit 131, which has the same functions as the conventional the pre-matrix processing unit 1251, obtains the BC information from the EQ unit 136 and generates a matrix $R_1$ based on the obtained BC information. More specifically, from the level information IID included in the spatial parameter of the BC information, the pre-matrix processing unit 131 derives a scaling coefficient as a part of the above-mentioned arithmetic coefficient.

The first arithmetic unit 133 calculates multiplication of (i) the first frequency band signal x expressed by a real number by (ii) the matrix $R_1$, and thereby outputs an intermediate signal v represents the result of this matrix arithmetic operation. More specifically, in the present embodiment, the pre-matrix processing unit 131 and the first arithmetic unit 133 form a pre-matrix module which scales the first frequency band signal x.

The real number decorrelater 135 generates and outputs a decorrelated signal w, by performing all-pass filter processing for the intermediate signal v represented by a real number.

This real number decorrelater 135 uses a real number (real-number lattice coefficient) $\phi_c^{n,m}$ as shown in the following equation 16, not a complex number (complex-number lattice coefficient) $\phi_c^{n,m}$ as shown in the following equation 15. Thereby, it is possible to eliminate non-integral retardation coefficients.

$$\phi_c^{n,m} = \exp\left(\frac{j}{2}\phi_c^n q^m\right) l_{c,i}^n \quad \text{[equation 15]}$$

$$\phi_c^{n,m} = l_{c,i}^n \quad \text{[equation 16]}$$

The post-matrix processing unit 132, which has the same functions as the conventional the post-matrix processing unit 1252, obtains BC information via the EQ unit 136 and generates a matrix $R_2$ based on the obtained BC information. More specifically, from the correlation information ICC or the phase information IPD included in the spatial parameter of the BC information, the post-matrix processing unit 132 derives a mixing coefficient as a part of the above-mentioned arithmetic coefficient.

The second arithmetic unit 134 calculates multiplication of (i) the decorrelated signal w expressed by a real number by (ii) the matrix $R_2$, and thereby outputs an output signal y which is a frequency band signal representing the result of this matrix arithmetic operation. More specifically, in the present embodiment, the post-matrix processing unit 132 and the second arithmetic unit 134 form a post-matrix module which mixes the first frequency band signal x and the decorrelated signal w together, using the mixing coefficient.

The synthesis filter bank 140 includes a real number INyq unit 141 and a real number IQMF unit 142.

The real number INyq unit 141 includes an inverse-Nyquist filter for real number coefficients, and the real number IQMF unit 142 includes an inverse-QMF filter for real number coefficients. With the structure, the synthesis filter bank 140 converts the output signal y expressed by real numbers, into temporal signals of audio signals of six channels, and then outputs the resulting signals.

Furthermore, the real number IQMF unit 142 uses a real number (real-number modulation coefficient) $N_r(k,n)$ as shown in the following equation 18, not a complex number (complex-number modulation coefficient) $N_r(k,n)$ as shown in the following equation 17, for example.

$$N_r(k, n) = \frac{1}{64}\exp\left(\frac{\pi(k+0.5)(2n-255)}{128}\right) \quad \text{[equation 17]}$$

$$N_r(k, n) = \frac{1}{32}\cos\left(\frac{\pi(k+0.5)(2n-64)}{128}\right) \quad \text{[equation 18]}$$

Figure 10:
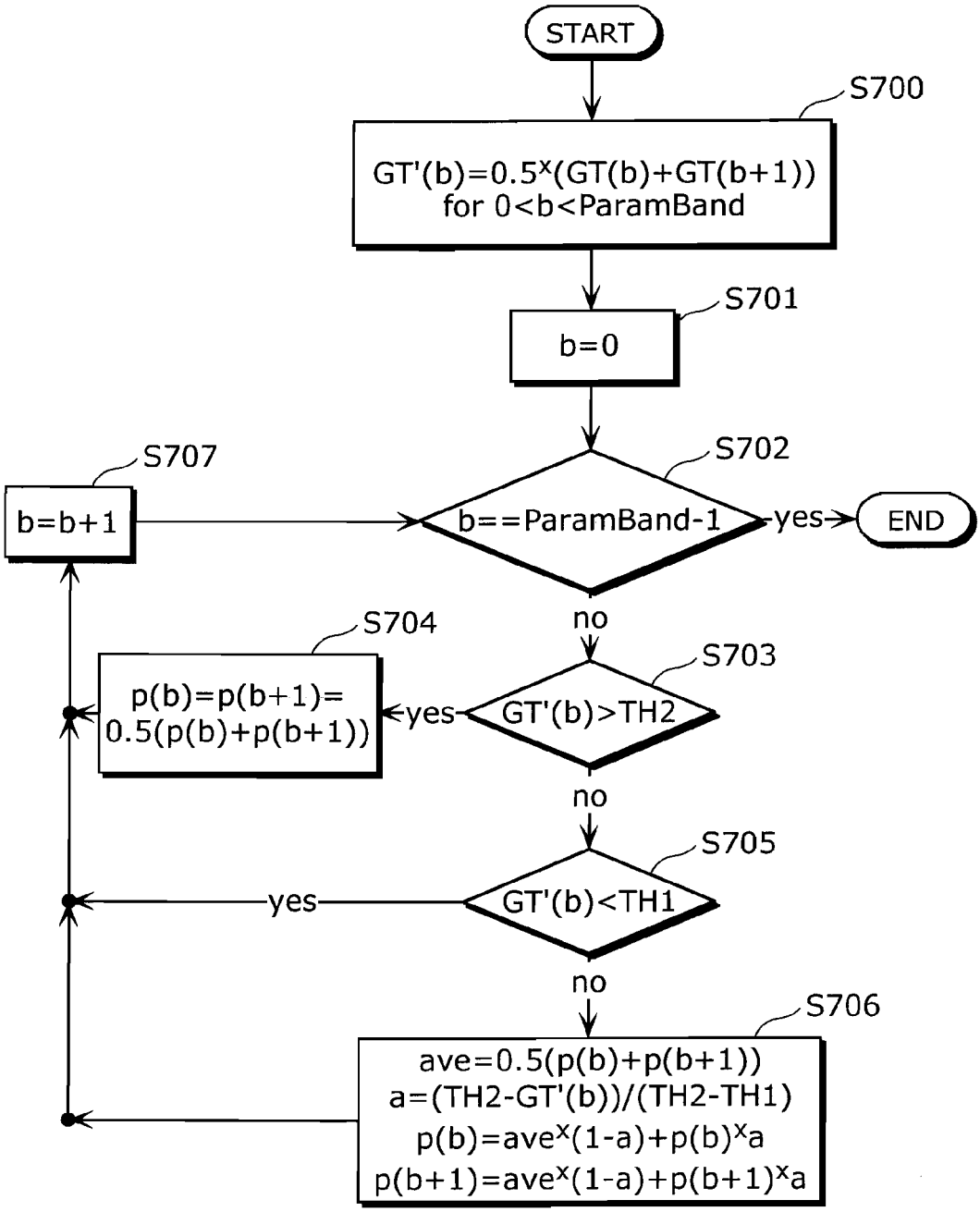
FIG. 10 is a flowchart showing operation performed by a TD unit and an EQ unit.

FIG. 10 is a flowchart showing processing performed by the TD unit 120 and the EQ unit 136.

Firstly, the TD unit 120 analyzes the first frequency band signal x outputted from the analysis filter bank 110, and thereby calculates an average tonality GT'(b) in a range where the parameter band b ranges from 0 and PramBand (Step S700). The average tonality GT'(b) is an average value of a tonality GT(b) of the parameter band b and a tonality GT (b+1) of a parameter band (b+1) adjacent to the parameter band b.

Next, the TD unit 120 initializes the parameter band b to 0 (Step S701), and determines whether or not the parameter band b reaches (ParamBand−1), in other words, whether or not a band indicated by the parameter band b is the second band to the last (Step S702).

Here, if the determination is made that the parameter band b reaches (ParamBand−1) (yes at S702), then the TD unit 120 completes the aliasing noise detection processing. On the other hand, if the determination is made that the parameter band b does not reach (ParamBand−1) (no at S702), then the TD unit 120 further determines whether or not the average tonality GT'(b) is larger than the predetermined threshold value TH2 (Step S703).

If the determination is made that the average tonality GT' (b) is larger than the threshold value TH2 (yes at Step S703), then the TD unit 120 detects a possibility of aliasing noise occurrence, and then notifies the EQ unit 136 of the result of the detection. In receiving the notification of the detection result, the EQ unit 136 replaces the spatial parameter p(b) of the parameter band (b) and the special parameter p(b+1) of the parameter band (b+1) to an average values of these spatial parameters, respectively, so that the spatial parameter p(b) and the spatial parameter p(b+1) become equal. Then, the TD unit 120 increases a value of the parameter band b by only 1 (Step S707), and then repeats the processing from the Step S702.

On the other hand, if the determination is made that the average tonality GT'(b) is equal to or less than the threshold value TH2 (no at Step S703), then the TD unit 120 further determines whether or not the average tonality GT'(b) is less than the threshold value TH1 (Step S705). Here, the threshold value TH1 is less than the threshold value TH2.

Here, if the determination is made that the average tonality GT'(b) is less than the threshold value TH1 (yes at Step S705), then the TD unit 120 repeats the processing from the Step S707. On the other hand, if the determination is made that the average tonality GT'(b) is equal to or more than the threshold value TH1 (no at Step S705), the TD unit 120 notifies the EQ unit 136 of the determination result, that is, the average tonality GT'(b) and the threshold values TH1 and TH2.

In receiving the above notification, the EQ unit 136 calculates (i) a spatial parameter p(b)=ave×(1−a)+p(b)×a of the parameter band b, and (ii) a spatial parameter p(b+1)=ave×(1−a)+p(b+1)×a of the parameter band (b+1) (Step S706). Here, ave=0.5×(p(b)+p(b+1)), and a=(TH2−GT'(b))/(TH2−TH1).

In other words, the EQ unit 136 performs linear interpolation of the spatial parameters p(b) and p(b+1), for all average tonalities TG'(b) between the threshold value TH1 and the threshold value TH2. More specifically, if the average tonality GT'(b) is close to the threshold value TH1, in other words, if the tonality is small, the spatial parameters p(b) and p(b+1) become close to the respective original values. On the other hand, if the average tonality GT'(b) is close to the threshold value TH2, in other words, if the tonality is large, the spatial parameters p(b) and p(b+1) become close to the average value.

As described above, in the present embodiment, the channel expansion unit 130 adjusts the spatial parameters in order to suppress occurrence of aliasing noises. Thereby, the aliasing noise is suppressed using a much smaller amount of processing, in comparison with the apparatus in which the last stage of the channel expansion unit 130 has noise cancellation units for respective channels. This realizes an audio decoder having a small circuit size or a program size. As a result, it is possible to achieve low power consumption, reduction of memory capacity, and chip down-sizing.

(First Variation)

Here, the first variation of the present embodiment is described.

It has been described in the present embodiment that the EQ unit 136 equalizes the spatial parameter p based on the detection result of the TD unit 120. However, the EQ unit of the first variation equalizes the matrix $R_1$ generated by the pre-matrix processing unit 131 and also equalizes the matrix $R_2$ generated by the post-matrix processing unit 132.

Figure 11:
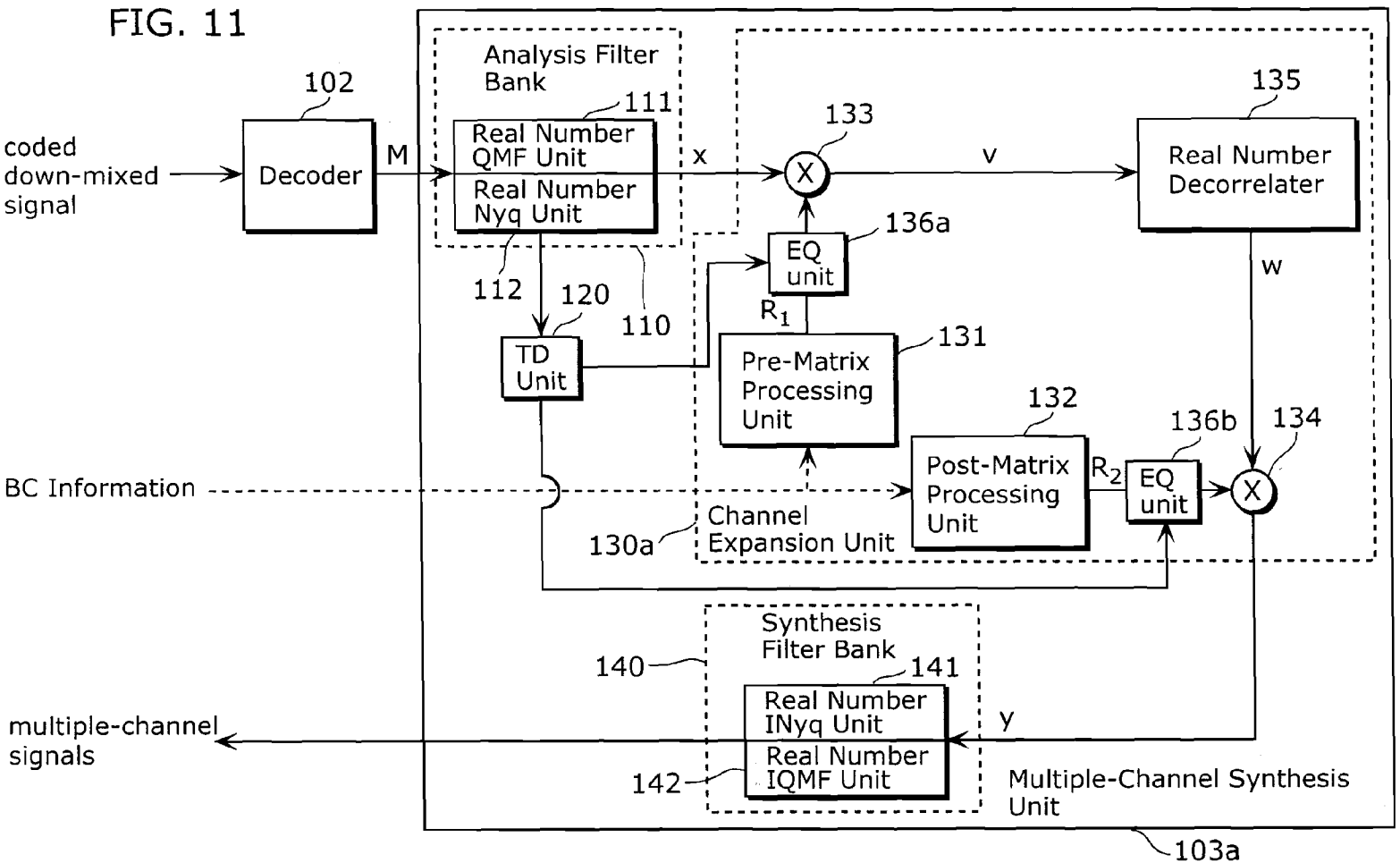
FIG. 11 is a block diagram showing a detailed structure of a multiple-channel synthesis unit according to the first variation of the embodiment.

FIG. 11 is a block diagram showing a detailed structure of a multiple-channel synthesis unit according to the first variation.

The multiple-channel synthesis unit 103*a* of the first variation has a channel expansion unit 130*a* instead of the channel expansion unit 130 of the embodiment.

The channel expansion unit 130*a* includes an EQ unit 136*a* and an EQ unit 136*b* which have the same functions as the EQ unit 136 of the embodiment.

More specifically, the EQ unit 136*a* equalizes a matrix $R_1$ (scaling coefficient) outputted from the pre-matrix processing unit 131 based on the detection result of the TD unit 120, and the EQ unit 136*b* equalizes a matrix $R_2$ (mixing coefficient) outputted from the post-matrix processing unit 132 based on the detection result of the TD unit 120.

As shown in the following equation 19, the EQ unit 136*a* treats a matrix $R_1(b)$ as a target to be processed, instead of the spatial parameter p(b) which is the target to be processed by the EQ unit 136.

$$p(b)=R_1(b) \quad \text{[equation 19]}$$

As shown in the following equation 20, the EQ unit 136*b* treats a matrix $R_2(b)$ as a target to be processed, instead of the spatial parameter p(b) which is the target to be processed by the EQ unit 136.

$$p(b)=R_2(b) \quad \text{[equation 20]}$$

As described above, in the first variation, the channel expansion unit 130 directly adjusts the matrixes $R_1$ and $R_2$ which are arithmetic coefficients, in order to suppress occurrence of aliasing noises. Thereby, the aliasing noise is suppressed using a much smaller amount of processing, in comparison with the apparatus in which the last stage of the channel expansion unit 130 has noise cancellation units for respective channels. As a result, it is possible to realize an audio decoder having a small circuit size or a program size.

(Second Variation)

Here, the second variation of the present embodiment is described.

It has been described in the embodiment that real numbers are used for all frequency bands of the frequency band signals. However, in the second variation, complex numbers are used for low frequency bands of the frequency band signals. In other words, in the second embodiment, real numbers are used only for a part of the frequency band signals.

Figure 12:
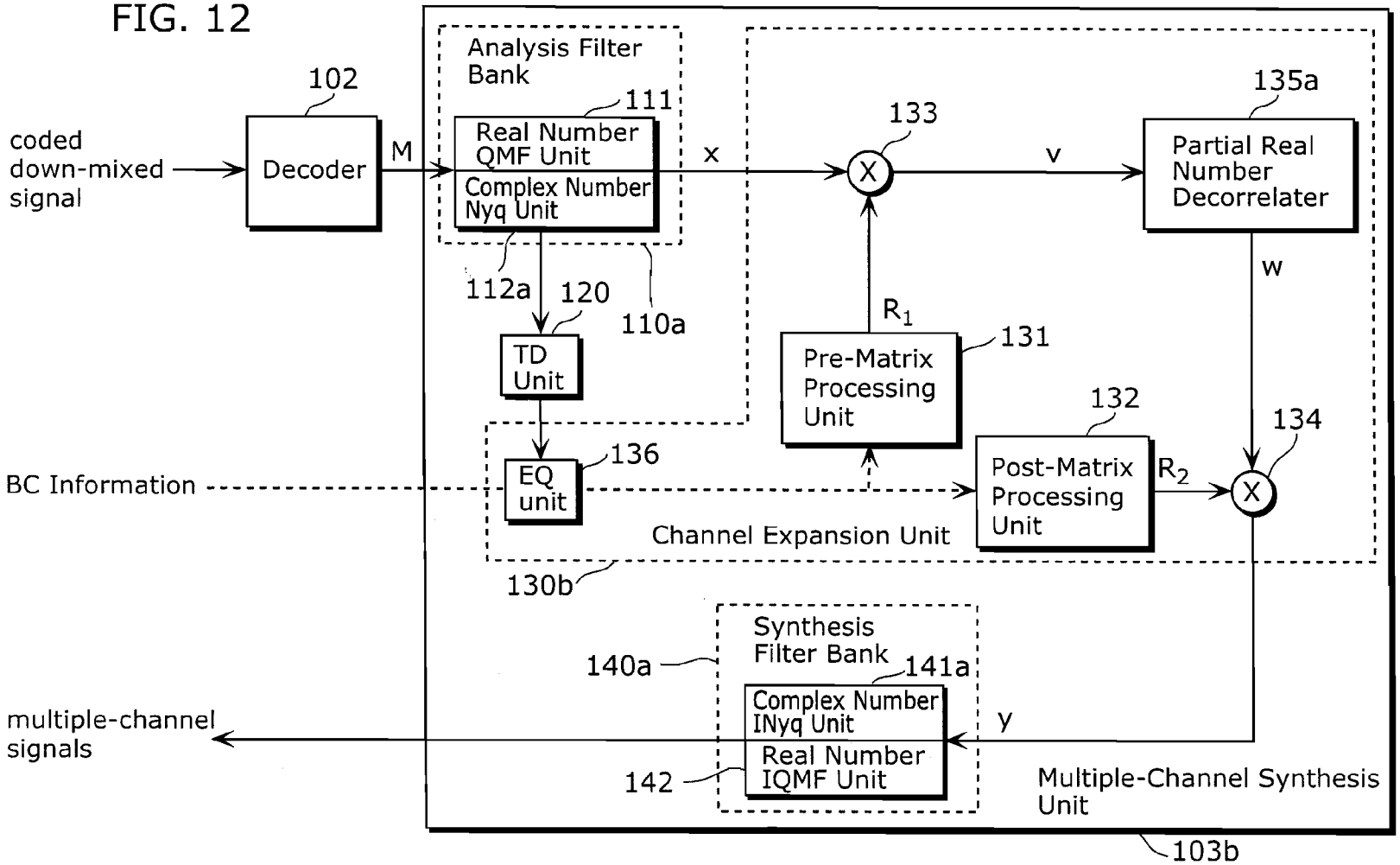
FIG. 12 is a block diagram showing a detailed structure of a multiple-channel synthesis unit according to the second variation of the embodiment.

FIG. 12 is a block diagram showing a detailed structure of a multiple-channel synthesis unit according to the second variation.

The multiple-channel synthesis unit 103*b* according to the second variation includes an analysis filter bank 110*a*, a channel expansion unit 130*b*, and a synthesis filter bank 140*a*.

The analysis filter bank 110*a* converts a down-mixed signal into a signal of a time/frequency hybrid expression, and eventually outputs the signal as the first frequency band signal x. The analysis filter bank 110*a* includes the real number QMF unit 111 and the complex number Nyq unit 112*a* described above.

The complex number Nyq unit 112*a* includes a Nyquist filter bank for complex number coefficients. Regarding a low frequency band of the first frequency band signal x generated by the real number QMF unit 111, the complex number Nyquist filter modifies the first frequency band signal x corresponding to the low frequency band.

As described above, the analysis filter bank 110*a* generates and outputs the first frequency band signal by which the low frequency band is expressed partly by a real number.

The channel expansion unit 130*b* includes the pre-matrix processing unit 131, the post-matrix processing unit 132, the first arithmetic unit 133, and the second arithmetic unit 134 which are described above, and further a partial real number decorrelater 135*a*.

The partial real number decorrelater 135*a* performs all-pass filter for an intermediate signal v outputted from the first arithmetic unit 133 based on the first frequency band signal x expressed partly by a real number, thereby generating and outputting a decorrelated signal w.

The synthesis filter bank 140*a* converts an expression format of the output signal y of the channel expansion unit 130, from the time/frequency hybrid expression into a time expression. The synthesis filter bank 140*a* includes the real number IQMF unit 142 and the complex number Inyq unit 141*a*. The complex number Inyq unit 141*a* is an inverse-Nyquist filter for complex number coefficients. The complex number Inyq unit 141*a* generates the first frequency band signal x expressed by an complex number. Then, the real number IQMF unit 142 performs synthesis filter processing for the processing result of the complex number INyq unit 141*a* using the real number inverse QMF, thereby outputting temporal signals of multiple-channels.

As described above, in the second variation, signals in the low frequency band are processed directly as complex numbers, which makes it possible to reduce an amount of arithmetic operations, while maintaining band resolution with high accuracy. Thereby, it is possible to balance the improvement of sound quality and the reduction of a circuit size.

(Third Variation)

Here, the third variation of the present embodiment is described.

A multiple-channel synthesis unit according to the third variation has the characteristics of the first and second variations.

Figure 13:
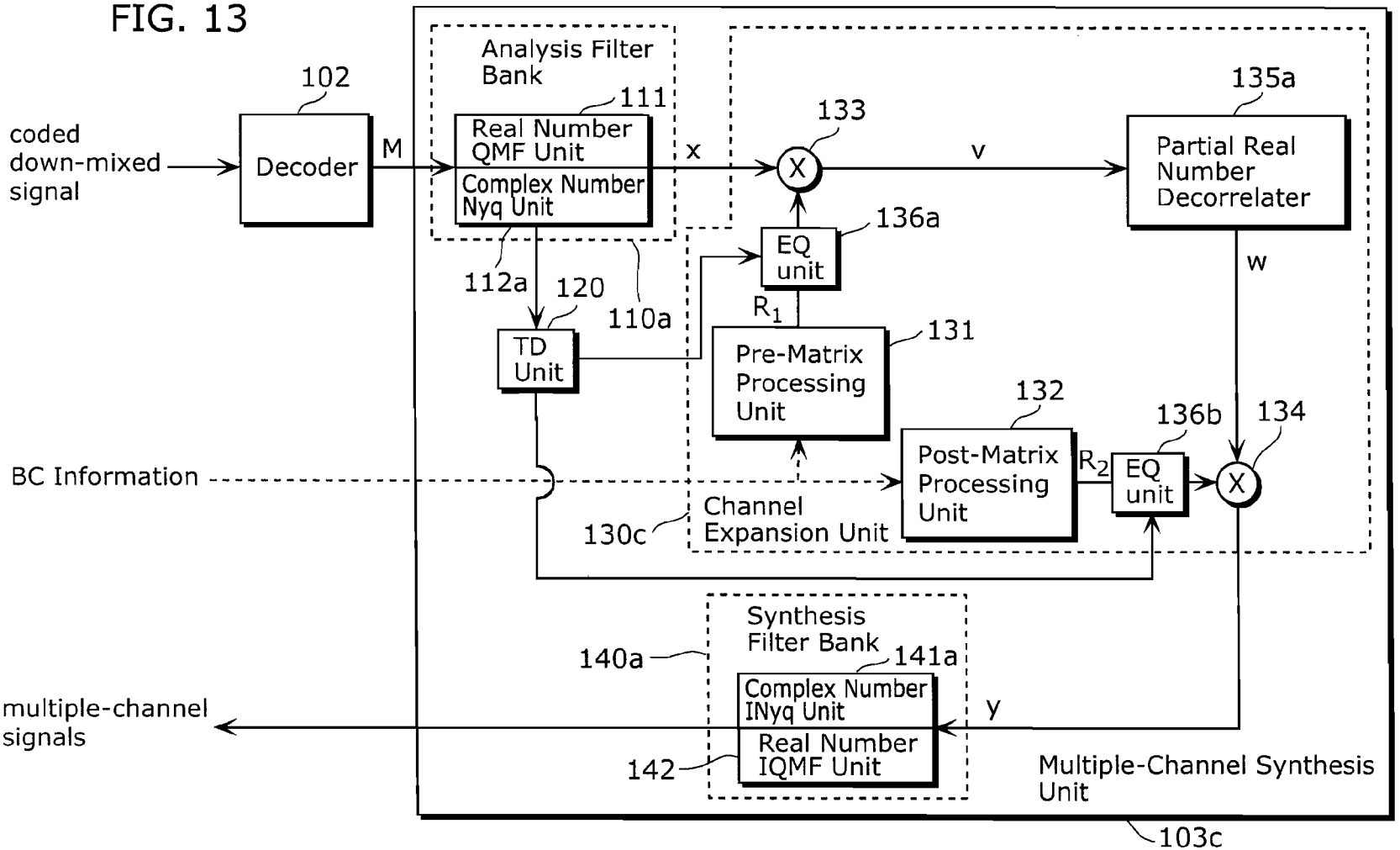
FIG. 13 is a block diagram showing a detailed structure of a multiple-channel synthesis unit according to the third variation of the embodiment.

FIG. 13 is a block diagram showing a detailed structure of the multiple-channel synthesis unit according to the third variation.

The multiple-channel synthesis unit 103*c* according to the third variation includes the analysis filter bank 110*a* of the second variation, the synthesis filter bank 140*a* of the second variation.

The channel expansion unit 130*c* includes the EQ units 136*a* and 136*b* of the first variation, and the partial real number decorrelater 135*a* of the second variation.

In other words, the multiple-channel synthesis unit 103*c* of the third variation equalizes the matrix $R_1$ generated by the pre-matrix processing unit 131, and also equalized the matrix $R_2$ generated by the post-matrix processing unit 132. In other words, the multiple-channel synthesis unit 103*c* according to the third embodiment uses real numbers only for a part of the frequency band signals.

(Fourth Variation)

Here, the fourth variation of the present embodiment is described.

It has been described in the above embodiment that the TD unit 120 and the EQ unit 136 averages the spatial parameter p(b) using the parameter bands adjacent to each other. However, in the fourth variation, the TD unit 120 and the EQ unit 136 averages the spatial parameter p(b) using a group of a plurality of consecutive parameter bands.

Figure 14:
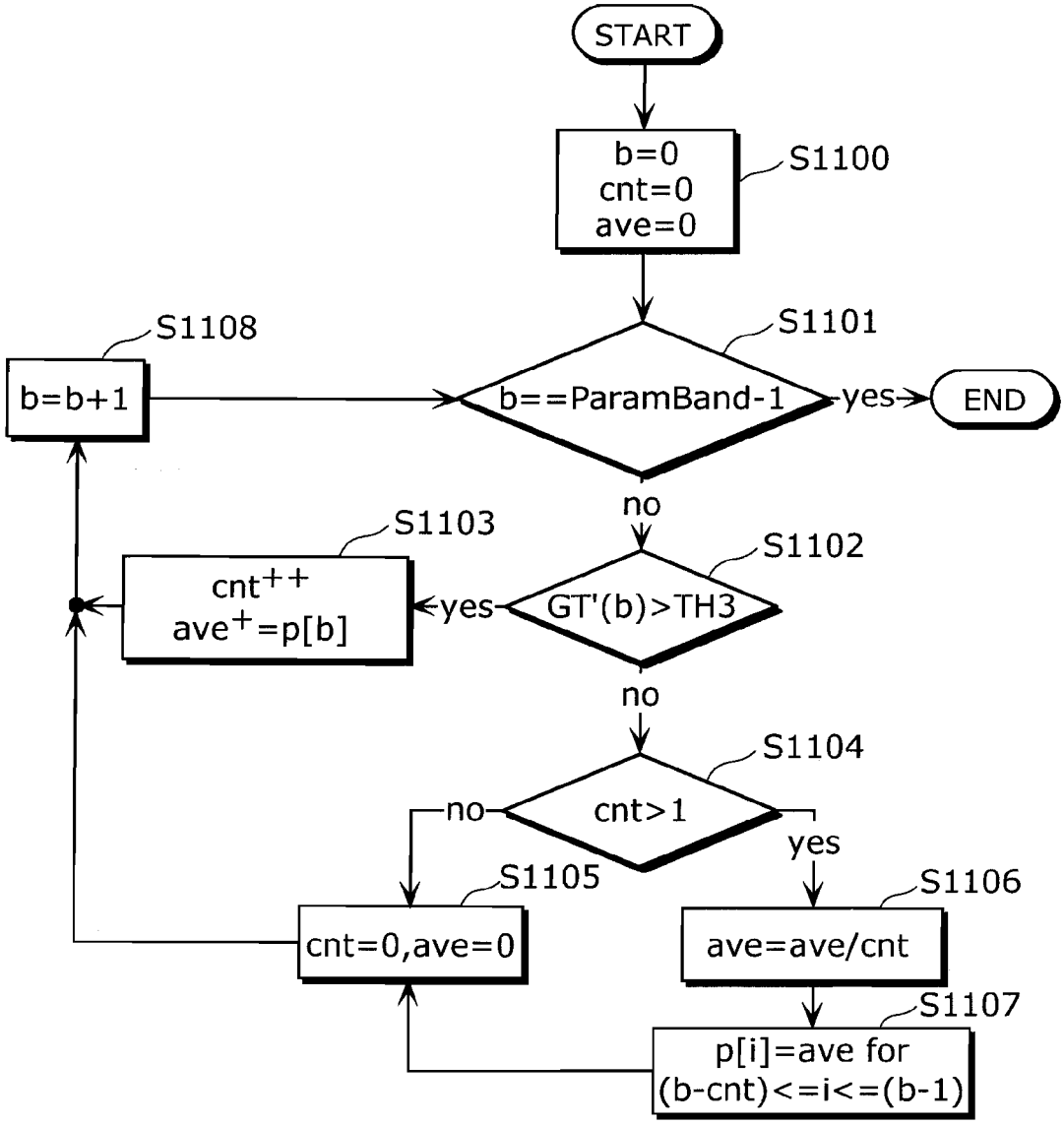
FIG. 14 is a flowchart showing operation performed by a TD unit and an EQ unit according to the fourth variation of the embodiment.

FIG. 14 is a flowchart showing processing performed by the TD unit 120 and EQ unit 136 according to the fourth variation.

Firstly, the TD unit 120 performs initialization, so that a parameter band b=0, a count value cnt=0, and an average value ave=0 (Step S1100). Next, the TD unit 120 determines whether or not the parameter band b reaches (ParamBand−1), in other words, whether or not a band indicated by the parameter band b is the second band to the last (Step S1101).

Here, when the determination is made that the parameter band b reaches (ParamBand−1) (Yes at S1101), then the TD unit 120 completes the aliasing noise detection processing. On the other hand, if the determination is made that the parameter band b does not reach (ParamBand−1) (no at S1101), the TD unit 120 further determines whether or not the average tonality GT'(b) is larger than the predetermined threshold value TH3 (Step S1102).

If the determination is made that the average tonality GT'(b) is larger than the threshold value TH3 (yes at Step S1102), then the TD unit 120 detects a possibility of aliasing noise occurrence, and then notifies the EQ unit 136 of the result of the detection. In receiving the result of the detection, the EQ unit 136 adds the spatial parameter p(b) of the parameter band b to the average value ave, thereby updating the average value, and increases the count value cnt by 1 (Steps S1103). Then, the TD unit 120 increases a value of the parameter band b by only 1 (Step S1108), and then repeats the processing from the Step S1101.

As described above, if the average tonality GT'(b) of each of the consecutive parameter bands b is larger than the threshold value TH3, the spatial parameters p(b) of the parameter band b are multiplied.

On the other hand, if the determination is made that the average tonality GT'(b) is equal to or less than the threshold value TH3 (no at Step S1102), then the TD unit 120 further determines whether or not the current count value cnt is larger than 1 (Step S1104). If the determination is made that the count value cnt is larger than 1 (yes at Step S1104), then the TD unit 120 divides the average value ave by the count value cnt, thereby updating the average value ave (Step S1106). Then, the TD unit 120 notifies the EQ unit 136 of the updated average value ave.

The EQ unit 136 updates spatial parameters p(i) of parameter bands i within a range from (b-cnt) to (b-1), so that the spatial parameters p(i) become the average value ave notified by the TD unit 120 (Step S1107).

On the other hand, if the determination is made that the count value cnt is equal to or less than 1 (no at Step S1104), or if the EU unit 136 updates the spatial parameters p(i) at Step S1107 as described above, then the TD unit 120 sets the count value cnt and the average value ave to 0 (Step S1105). Then, the TD unit 120 repeats the processing from the Step S1108.

As described above, in the fourth variation, the spatial parameters p(b) are averaged among the group of consecutive parameter bands each having an average tonality GT'(b) larger than the threshold value TH3.

Note that all or a part of the units included in the audio decoder according to the embodiment and the variations can be implemented as an integrated circuit such as a Large Scale Integration (LSI). Moreover, the processing performed by the integrated circuit can be realized as a program.

INDUSTRIAL APPLICABILITY

The audio decoder according to the present invention has advantages of reducing an amount of arithmetic operations while suppressing occurrence of aliasing noise. Especially, the audio decoder is useful in application for low bit rate of broadcast and the like. The audio decoder is able to be applied in, for example, home theater systems, in-vehicle sound systems, electronic game systems, and the like.

The invention claimed is:

1. An audio decoder which decodes a bitstream to generate audio signals of N channels, where N is equal to or larger than 2, the bitstream including a first coded data and a second coded data, the first coded data being generated by coding a down-mixed signal obtained by down-mixing the audio signals of the N channels, and the second coded data being generated by coding a parameter to be used to restore the down-mixed signals into original audio signals of the N channels, said audio decoder comprising:

a frequency band signal generation unit operable to generate a first frequency band signal from the first coded data, the first frequency band signal corresponding to the down-mixed signal, and the first frequency band signal being expressed by a real number, regarding at least a part of frequency bands of the first frequency band signals;

a channel expansion unit operable to convert the first frequency band signal into second frequency band signals using the second coded data, the first frequency band signal being generated by said frequency band signal generation unit, and the second frequency band signals corresponding to the respective audio signals of the N channels;

a band synthesis unit operable to perform band synthesis for the second frequency band signals of the N channels which are generated by said channel expansion unit, thereby converting the second frequency band signals into the audio signals of the N channels, the audio signals being expressed on a time axis; and an aliasing noise detection unit operable to detect occurrence of an aliasing noise in the first frequency band signal, the aliasing noise resulting from that the first frequency band signal is expressed by the real number, wherein said aliasing noise detection unit is operable to detect a frequency band regarding the first frequency band signal, the frequency band having a signal with a high tonality where a signal level of a frequency component is maintained strong, the second coded data is data generated by coding a spatial parameter which includes a level ratio and a phase difference between the original audio signals of the N channels, and said channel expansion unit includes an adjustment module operable to adjust the signal level by adjusting an arithmetic coefficient generated from the spatial parameter, regarding a frequency band adjacent to the frequency band detected by said aliasing noise detection unit, wherein said channel expansion unit is operable to suppress the aliasing noise from being included in the second frequency band signals, by (i) generating the second frequency band signal, by mixing the first frequency band signal and a decorrelated signal by a ratio, the decorrelated signal being generated from the first frequency band signal, and the ratio corresponding to the arithmetic coefficient generated from the spatial parameter, and (ii) outputting the second frequency band signal in which a signal level is adjusted by said adjustment module.

2. The audio decoder according to claim 1, wherein said frequency band signal generation unit includes a Nyquist filter bank operable to increase a band resolution for a predetermined frequency band, and said frequency band signal generation unit is operable to (i) generate a frequency band signal expressed by a complex number for a frequency band which is processed by said Nyquist filter bank, and (ii) generate a frequency band signal expressed by a real number for a frequency band which is not processed by said Nyquist filter bank.

3. The audio decoder according to claim 1, wherein said channel expansion unit includes:

a pre-matrix module operable to generate an intermediate signal by scaling the first frequency band signal, using, as a part of the arithmetic coefficient, a scaling coefficient which is derived from the level ratio included in the spatial parameter; and a decorrelation module operable to generate the decorrelated signal, by performing all-pass filtering for the intermediate signal generated by said pre-matrix module;

wherein said channel expansion unit is further operable to mix the first frequency band signal and the decorrelated signal, using, as a part of the arithmetic coefficient, a mixing coefficient which is derived from the phase difference included in the spatial parameter, and said adjustment module is operable to adjust the arithmetic coefficient by adjusting the spatial parameter.

4. The audio decoder according to claim 1, wherein said adjustment module includes an equalizer operable to equalize the scaling coefficients regarding (i) the frequency band detected by said aliasing noise detection unit and (ii) the frequency band adjacent to the detected frequency band, and thereby adjusting the arithmetic coefficient.

5. The audio decoder according to claim 1, wherein said adjustment module includes an equalizer operable to equalize the mixing coefficients regarding (i) the frequency band detected by said aliasing noise detection unit and (ii) the frequency band adjacent to the detected frequency band, and thereby adjusting the arithmetic coefficient.

6. The audio decoder according to claim 3, wherein said adjustment module includes an equalizer operable to equalize the spatial parameters regarding (i) the frequency band detected by said aliasing noise detection unit and (ii) the frequency band adjacent to the detected frequency band.

7. The audio decoder according to claim 4, wherein said equalizer is operable to perform the equalizing, by replacing each component to be equalized with an average value of the components.

8. A decoding method for decoding a bitstream to generate audio signals of N channels, where N is equal to or larger than 2, the bitstream including a first coded data and a second coded data, the first coded data being generated by coding a down-mixed signal obtained by down-mixing the audio signals of the N channels, and the second coded data being generated by coding a parameter to be used to restore the down-mixed signals into original audio signals of the N channels, said decoding method comprising steps of:

generating a first frequency band signal from the first coded data, the first frequency band signal corresponding to the down-mixed signal, and the first frequency band signal being expressed by a real number, regarding at least a part of frequency bands of the first frequency band signals;

converting the first frequency band signal into second frequency band signals using the second coded data, the first frequency band signal being generated in said generating, and the second frequency band signals corresponding to the respective audio signals of the N channels;

performing band synthesis for the second frequency band signals of the N channels which are generated in said converting, thereby converting the second frequency band signals into the respective audio signals of the N channels, the audio signals are expressed on a time axis; and detecting occurrence of an aliasing noise in the first frequency band signal, the aliasing noise resulting from that the first frequency band signal is expressed by the real number, wherein in said detecting, a frequency band is detected regarding the first frequency band signal, the frequency band having a signal with a high tonality where a signal level of a frequency component is maintained strong, the second coded data is data generated by coding a spatial parameter which includes a level ratio and a phase difference between the original audio signals of the N channels, and said converting of the first frequency band signal includes adjusting the signal level by adjusting an arithmetic coefficient generated from the spatial parameter, regarding a frequency band adjacent to the frequency band detected in said detecting, wherein, in said converting of the first frequency band signal, the aliasing noise is suppressed from being included in the second frequency band signals, by (i) generating the second frequency band signal, by mixing the first frequency band signal and a decorrelated signal by a ratio, the decorrelated signal being generated from the first frequency band signal, and the ratio corresponding to the arithmetic coefficient generated from the spatial parameter, and (ii) outputting the second frequency band signal in which a signal level is adjusted in said adjusting.

* * * * *